US010799881B2

(12) United States Patent
Incera Garrido et al.

(10) Patent No.: US 10,799,881 B2
(45) Date of Patent: Oct. 13, 2020

(54) ENERGY INPUT DURING AGGLOMERATION FOR MAGNETIC SEPARATION

(71) Applicant: BASF SE, Ludwigshafen (DE)

(72) Inventors: Gerardo Incera Garrido, Kassel (DE); Rodrigo Ivan Serna Guerrero, Mannheim (DE); Igor Shishkov, Muenster (DE); Reinhold Rieger, Mutterstadt (DE); Lars Vicum, Heidelberg (DE)

(73) Assignee: BASF SE (DE)

( * ) Notice: Subject to any disclaimer, the term of this patent is extended or adjusted under 35 U.S.C. 154(b) by 537 days.

(21) Appl. No.: 15/527,820

(22) PCT Filed: Nov. 27, 2015

(86) PCT No.: PCT/EP2015/077918
§ 371 (c)(1),
(2) Date: May 18, 2017

(87) PCT Pub. No.: WO2016/083575
PCT Pub. Date: Jun. 2, 2016

(65) Prior Publication Data

US 2017/0320068 A1 Nov. 9, 2017

(30) Foreign Application Priority Data

Nov. 27, 2014 (EP) ..... 14195166

(51) Int. Cl.
*B03C 1/01* (2006.01)
*B03C 1/02* (2006.01)
(Continued)

(52) U.S. Cl.
CPC ..... *B03C 1/01* (2013.01); *B02C 23/08* (2013.01); *B03C 1/002* (2013.01); *B03C 1/015* (2013.01);
(Continued)

(58) Field of Classification Search
CPC .. B03C 1/01; B03C 1/02; B03C 1/002; B03C 1/015
(Continued)

(56) References Cited

U.S. PATENT DOCUMENTS 4,367,143 A 1/1983 Carpenter
4,637,143 A 1/1987 Carpenter
(Continued)

FOREIGN PATENT DOCUMENTS

AU 774023 B2 6/2004
AU 2011224015 A1 4/2012
(Continued)

OTHER PUBLICATIONS

Search Report for PCT/EP2015/077918 dated Feb. 9, 2016.
(Continued)

*Primary Examiner* — Terrell H Matthews
(74) *Attorney, Agent, or Firm* — Faegre Drinker Biddle & Reath LLP

(57) ABSTRACT

Method for separating first type particles from a mixture of at least first type particles and second type particles, the method comprising contacting in a dispersion medium first type particles and second type particles with magnet type particles, so that in the dispersion medium first type particles agglomerate to magnet type particles to obtain magnetic agglomerates, separating magnetic agglomerates from second type particles by applying a magnetic field; wherein during step an amount of energy is transferred into a mixture
(Continued)

of the dispersion medium, first type particles, second type particles and magnet type particles.

20 Claims, 2 Drawing Sheets

(51) Int. Cl.
*B03C 1/015* (2006.01)
*B02C 23/08* (2006.01)
*B03C 1/00* (2006.01)

(52) U.S. Cl.
CPC ..... *B03C 1/02* (2013.01); *B03C 2201/18* (2013.01); *B03C 2201/20* (2013.01)

(58) Field of Classification Search
USPC ..... 209/3, 4, 8
See application file for complete search history.

(56) References Cited

U.S. PATENT DOCUMENTS

| | | | | |
|---|---|---|---|---|
| 4,657,666 | A | 4/1987 | Snook et al. | |
| 4,946,590 | A | 8/1990 | Hertzog | |
| 5,051,199 | A | 9/1991 | Barwise | |
| 5,200,071 | A | 4/1993 | Spiegel | |
| 8,318,025 | B2 | 11/2012 | Domke et al. | |
| 8,329,039 | B2 | 12/2012 | Domke et al. | |
| 8,377,311 | B2 | 2/2013 | Domke et al. | |
| 8,377,312 | B2 | 2/2013 | Domke et al. | |
| 8,377,313 | B2 | 2/2013 | Domke et al. | |
| 8,408,395 | B2 | 4/2013 | Domke et al. | |
| 8,434,623 | B2 | 5/2013 | Domke et al. | |
| 8,486,270 | B2 | 7/2013 | Rieger et al. | |
| 8,715,494 | B2 | 5/2014 | Danov et al. | |
| 8,840,794 | B2 | 9/2014 | Danov et al. | |
| 8,858,801 | B2 | 10/2014 | Domke et al. | |
| 8,916,049 | B2 * | 12/2014 | Nishijima | B03C 1/286 209/214 |
| 9,028,687 | B2 | 5/2015 | Goraj | |
| 9,028,699 | B2 | 5/2015 | Danov et al. | |
| 9,126,206 | B2 | 9/2015 | Hartmann et al. | |
| 2010/0300941 | A1 * | 12/2010 | Domke | B03C 1/015 209/8 |
| 2011/0168618 | A1 | 7/2011 | Danov et al. | |
| 2011/0174710 | A1 | 7/2011 | Hartmann et al. | |
| 2011/0240527 | A1 * | 10/2011 | Domke | B03C 1/015 209/8 |
| 2011/0272623 | A1 | 11/2011 | Domke et al. | |
| 2012/0132032 | A1 | 5/2012 | Domke et al. | |
| 2012/0228413 | A1 * | 9/2012 | Rieger | B03C 1/32 241/16 |
| 2013/0087505 | A1 | 4/2013 | Danov et al. | |
| 2013/0256233 | A1 | 10/2013 | Danov et al. | |
| 2013/0313177 | A1 | 11/2013 | Danov et al. | |
| 2013/0319912 | A1 * | 12/2013 | Michailovski | B03C 1/01 209/8 |
| 2016/0317951 | A1 | 11/2016 | Incera Garrido et al. | |
| 2017/0320068 | A1 * | 11/2017 | Incera Garrido | B03C 1/015 |

FOREIGN PATENT DOCUMENTS

| | | | |
|---|---|---|---|
| CA | 2832814 | A1 | 10/2012 |
| CN | 101815581 | A | 8/2010 |
| CN | 102217817 | A | 10/2011 |
| CN | 102725067 | A | 10/2012 |
| CN | 103228362 | A | 7/2013 |
| DE | 202011104707 | U1 | 2/2012 |
| DE | 102010061952 | A1 | 5/2012 |
| EP | 1200408 | A2 | 5/2002 |
| EP | 1974821 | A1 | 10/2008 |
| SU | 1212969 | A1 | 2/1986 |
| WO | WO-0109099 | A2 | 2/2001 |
| WO | WO-020066168 | A1 | 8/2002 |
| WO | WO-2009010422 | A1 | 1/2009 |
| WO | WO-2009065802 | A2 | 5/2009 |
| WO | WO-2010007075 | A1 | 1/2010 |
| WO | WO-2010007157 | A1 | 1/2010 |
| WO | WO-2010031617 | A1 | 3/2010 |
| WO | WO-2010066770 | A1 | 6/2010 |
| WO | WO-2010097361 | A1 | 9/2010 |
| WO | WO-2010100180 | A1 | 9/2010 |
| WO | WO-20110058039 | A1 | 5/2011 |
| WO | WO-2011064757 | A1 | 6/2011 |
| WO | WO-2011107353 | A1 | 9/2011 |
| WO | WO-2011131411 | A1 | 10/2011 |
| WO | WO-2011134710 | A1 | 11/2011 |
| WO | 102010023130 | A1 | 12/2011 |
| WO | WO-2011154178 | A1 | 12/2011 |
| WO | WO-2011154540 | A1 | 12/2011 |
| WO | WO-2012072615 | A1 | 6/2012 |
| WO | WO-2012104292 | A1 | 8/2012 |
| WO | WO-2012107274 | A1 | 8/2012 |
| WO | WO-2012116909 | A1 | 9/2012 |
| WO | WO-2012140065 | A1 | 10/2012 |
| WO | WO-2013038192 | A1 | 3/2013 |
| WO | WO-2013167634 | A1 | 11/2013 |
| WO | WO-2015104324 | A1 | 7/2015 |
| WO | WO-2015110555 | A1 | 7/2015 |
| WO | WO-2016083491 | A1 | 6/2016 |

OTHER PUBLICATIONS

Written Opinion of the International Searching Authority for PCT/EP2015/077918 dated Feb. 9, 2016.
U.S. Appl. No. 15/128,447, filed Sep. 23, 2016.
U.S. Appl. No. 15/528,952, filed May 23, 2017.

* cited by examiner

ENERGY INPUT DURING AGGLOMERATION FOR MAGNETIC SEPARATION

CROSS-REFERENCE TO RELATED APPLICATIONS

This application is a national stage application (under 35 U.S.C. § 371) of PCT/EP2015/077918, filed Nov. 27, 2015, which claims benefit of European Application No. 14195166.5, filed Nov. 27, 2014, both of which are incorporated herein by reference in their entirety.

FIELD OF THE INVENTION

The present invention relates to a method for magnetic separation of valuable particles from an ore, and in particular to a method having an improved agglomeration of valuable particles to magnetic particles.

BACKGROUND OF THE INVENTION

Several processes for the separation of a desired material from a mixture comprising this desired material and, in addition, undesired materials are described in the prior art.

WO 02/066168 A1 relates to a process for separating ores from mixtures comprising these, in which suspensions or slurries of these mixtures are treated with particles which are magnetic and/or capable of floating and/or reporting to the froth phase of flotation in aqueous solutions. After addition of the magnetic particles and/or particles capable of floating, a magnetic field is applied so that the agglomerates are separated from the mixture. However, the extent to which the magnetic particles are bound to the ore and the strength of the bond is not sufficient for the process to be carried out with a satisfactorily high yield and effectiveness.

U.S. Pat. No. 4,657,666 discloses a process for the enrichment of ore minerals, in which the ore mineral present in the gangue is treated with magnetic particles, as a result of which agglomerates are formed due to hydrophobic interactions. The magnetic particles are hydrophobized on the surface by treatment with hydrophobic compounds, so that agglomeration to the ore minerals occurs. The agglomerates are then separated off from the mixture by means of a magnetic field. It is disclosed that the ores are treated with a surface-activating solution of sodium ethylxanthate, which may also be called sodium ethylxanthogenate, before the magnetic particle is added. In this process, separation of ore minerals and magnetic particle is effected by the destruction of the surface-activating substance which has been applied in the form of the surface-activating solution to the ore.

WO 2010/100180 A1 relates to an agglomerate of at least one particle P which is hydrophobized on the surface with at least one first surface-active substance and at least one magnetic particle MP which is hydrophobized on the surface with at least one second surface-active substance, a process for producing these agglomerates and the use of the agglomerates for separating a particle P from mixtures comprising these particles P and further components.

WO 2010/097361 A1 relates to a process for separating at least one first material from a mixture comprising this at least one first material, at least one second material and at least one third material, wherein the mixture to be treated is firstly brought into contact with at least one hydrocarbon in an amount of from 0.01 to 0.4% by weight, based on the sum of mixture and at least one hydrocarbon, this mixture is further brought into contact with at least one hydrophobic magnetic particle so that the magnetic particle and the at least one first material agglomerate and this agglomerate is separated from the at least one second material and the at least one third material by application of a magnetic field and, if appropriate, the at least one first material is subsequently separated, preferably quantitatively, from the magnetic particle, with the magnetic particle preferably being able to be re-circulated to the process.

WO 2010/066770 A1 discloses a process for separating at least one first material from a mixture comprising this at least one first material in an amount of from 0.001 to 1.0% by weight, based on the total mixture, and at least one second material, in which the first material is firstly brought into contact with a surface-active substance in order to hydrophobize it, i.e. to render it hydrophobic, this mixture is then brought into contact with at least one magnetic particle so that the magnetic particle and the hydrophobized first material agglomerate and this agglomerate is separated from the at least one second material by application of a magnetic field and the at least one first material is then preferably quantitatively separated from the magnetic particle, with the magnetic particle preferably being able to be re-circulated to the process.

WO 2010/007157 A1 discloses a process for separating at least one first material from a mixture comprising this at least one first material and at least one second material, in which the mixture to be separated is firstly brought into contact with at least one selective hydrophobizing agent so that an adduct is formed from the at least one hydrophobizing agent and the at least one first material, this adduct is then brought into contact with at least one magnetic particle functionalized on the surface with at least one polymeric compound having an LOST (lower critical solution temperature) at a temperature at which the polymeric compound has hydrophobic character so that the adduct and the at least one functionalized magnetic particle agglomerate, this agglomerate is separated off by application of a magnetic field and the agglomerate is subsequently dissociated by setting a temperature at which the polymeric compound has hydrophilic character.

WO 2010/007075 A1 relates to a process for separating at least one first material from a mixture comprising this at least one first material and at least one second material, in which the mixture to be separated is brought into contact with at least one bi-functional compound and at least one magnetic particle so that an adduct is formed from the at least one first material, the at least one bi-functional compound and the at least one magnetic particle, this adduct is dispersed in a suitable dispersion medium, the adduct is separated off by application of a magnetic field and the adduct which has been separated off is, if appropriate, disassociated by suitable measures in order to obtain the at least one first material.

WO 2009/065802 A2 relates to a process for separating at least one first material from a mixture comprising this at least one first material and at least one second material, in which a suspension of the mixture comprising at least one first material and at least one second material and at least one magnetic particle in a suitable suspension medium is firstly produced, the pH of this suspension is set to a value at which the at least one first material and the at least one magnetic particle bear opposite surface charges so that these agglomerate, the agglomerates obtained in this way are separated off by application of a magnetic field gradient and the agglomerates which has been separated off are dissociated by setting the pH to a value at which the at least one first material and the at least one magnetic particle bear the same surface charges in order to obtain the at least one first material separately.

WO 2011058039 A1 relates to a process for separating at least one first material from a mixture comprising this at least one first material and at least one second material, in which the at least one first material and at least one second material and at least one magnetic particle in a suitable suspension medium are brought together and mixed in such a way that the specific power input of mechanical energy is at least 10 kW/$m^3$. In another embodiment of that application a shear rate of at least 5000 1/s is given in order to achieve good agglomeration of the at least first particles with the magnetic particles.

US 20120132032 A1 discloses a process for the separation of at least one metal from a slag, comprising that at least one metal and further components, comprising at least step (A) grinding the slag, (B) if appropriate, contacting the ground slag of step (A) with at least one surface-active substance and/or at least one magnetic particle, if appropriate in the presence of at least one dispersant, resulting in formation of agglomerates of the at least one metal and the at least one magnetic particle, (C) if appropriate, addition of at least one dispersant to the mixture obtained in step (B) to give a dispersion having a suitable concentration, and (D) separation of the agglomerates from the mixture of step (B) or (C) by application of a magnetic field, and to the use of at least one magnetic particle for the separation of slag. The use of magnetic particles can be optional if the slag contains magnetically separable, valuable-containing particles.

Magnetic separation is also known from WO 2012/104292, WO 2011/131411, WO 2011/134710, WO 2011/154178, DE 10 2010 023 130, DE 20 2011 104 707, WO 2011/107353, DE 10 2010 061 952, WO 2012/116909, WO 2012/107274 or WO 2013/167634. In addition magnetic separation is described in "Magnetic Techniques for the Treatment of Materials", Jan Svoboda, ISBN 1-4020-2038-4, Kluwer Academic Publishers, 2004; "Minerals Engineering", Elsevier; "Minerals and Metallurgical Processing Journal", Society for Mining; "Metallurgy & Exploration Mining Engineering Magazine", Society for Mining, Metallurgy & Exploration; "International Journal of Mineral Processing", Elsevier; "International Journal of Mining Science and Technology", Elsevier.

The processes for separating desired valuable matter containing particles from a mixture comprising this desired material and further undesired second materials that are disclosed in the prior art can still be improved in respect of the yield of desired valuable matter and/or in respect of the grade of the obtained desired valuable material in agglomerates comprising the desired valuable matter containing material. An improvement of this separation process will further increase the efficiency of the whole valuable matter recovery process chain. For example, while upgrading the desired material in method of the invention, the amount of material to be treated in subsequent steps may be significantly lowered and thus, the whole valuable matter recovery process may be performed using less energy.

SUMMARY OF THE INVENTION

It can be considered as an object of the invention to provide a method for magnetic separation of valuable particles from an ore, where an improved agglomeration is achieved.

The object is solved by the subject matter of the independent claims. Further embodiments are incorporated in the dependent claims.

According to an embodiment of the invention there is provided a method for separating first type particles from a mixture of at least first type particles and second type particles, the method comprising (A) contacting in a dispersion medium first type particles and second type particles with magnet type particles, so that in the dispersion medium first type particles agglomerate to magnet type particles to obtain magnetic agglomerates; (B) separating magnetic agglomerates from second type particles by applying a magnetic field; wherein during step (A) an amount of mechanical shear energy of 0.001-10 kWh/m^3 is transferred into a mixture of the dispersion medium, first type particles, second type particles and magnet type particles.

Thus it is possible to improve the agglomeration of first type particles to magnet type particles by applying a particular amount of mechanical energy to the mixture of the dispersion medium, first type particles, second type particles and magnet type particles.

According to an embodiment of the invention, during step (A) an amount of mechanical shear energy of 0.001-0.2 kWh/m^3 is transferred into a mixture of the dispersion medium, first type particles, second type particles and magnet type particles According to an embodiment of the invention, during step (A) an amount of mechanical shear energy of 0.003-0.4 kWh/m^3 is transferred into a mixture of the dispersion medium, first type particles, second type particles and magnet type particles According to an embodiment of the invention, during step (A) an amount of mechanical shear energy of 0.05-10 kWh/m^3 is transferred into a mixture of the dispersion medium, first type particles, second type particles and magnet type particles According to an embodiment of the invention, during step (A) an amount of mechanical shear energy of 0.02-1.5 kWh/m^3 is transferred into a mixture of the dispersion medium, first type particles, second type particles and magnet type particles

A BRIEF DESCRIPTION OF THE FIGURES

Figure 1:
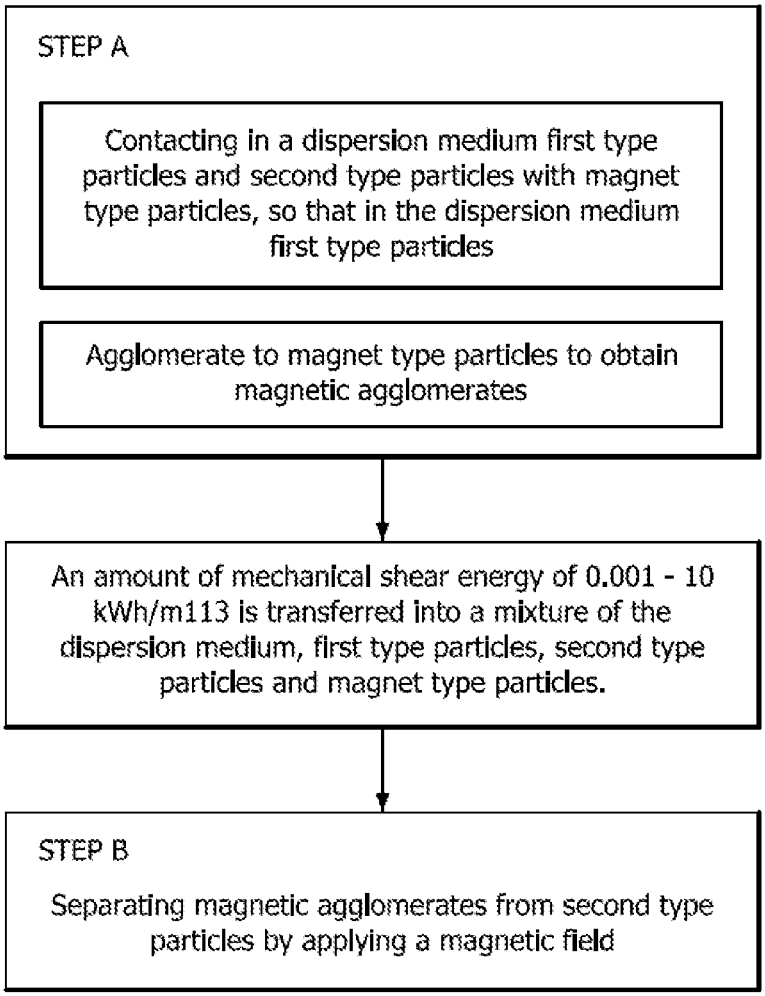
FIG. 1 illustrates an embodiment according to the invention.
Figure 2:
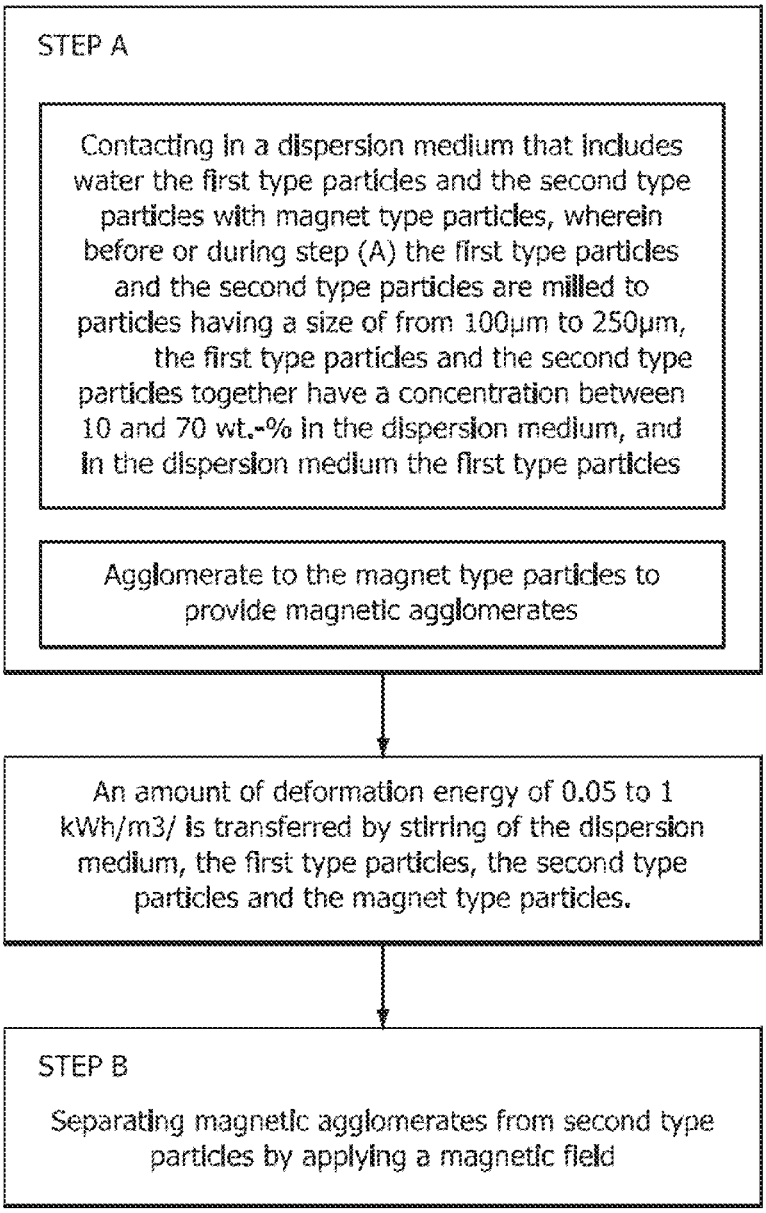
FIG. 2 illustrates another embodiment according to the invention.

According to an embodiment of the invention, during step (A) an amount of mechanical shear energy of 0.2-1.5 kWh/m^3 is transferred into a mixture of the dispersion medium, first type particles, second type particles and magnet type particles.

The interrelation between the amount of mechanical shear energy and the agglomeration may be determined by experiments and test as is illustrated in the examples given below. These experiments or tests may form a basis for a look up table illustrating the interrelation between the mechanical shear energy and the agglomeration for a given type of first particles and magnetic particles. The agglomeration being determined here by the relative mass of first type particles (i.e. the recovery of first type particles or a specific property of the first type particles characteristic for the first type particles e.g. the content of a specific element) separated in step (B).

DETAILED DESCRIPTION OF THE INVENTION

According to an embodiment of the invention there is provided a method for separating first type particles from a mixture of at least first type particles and second type particles, the method comprising: (A) contacting in a dispersion medium first type particles and second type particles with magnet type particles, so that in the dispersion medium first type particles agglomerate to magnet type particles to obtain magnetic agglomerates; (B) separating magnetic agglomerates from second type particles by applying a magnetic field; wherein during step (A) an amount of energy is transferred into the dispersion with a specific power sufficient to achieve an average turbulent shear rate of 100 to 5000 (one hundred to five thousand) 1/s in the dispersion.

According to an embodiment of this invention during step (A) an amount of energy is transferred into the dispersion with a specific power sufficient to achieve an average turbulent shear rate of 300 to 1000 (three hundred to one thousand) 1/s. The average turbulent shear rates being obtained from the Camp-Stein formula given below.

Thus it is possible to improve the agglomeration of first type particles to magnet type particles by applying an amount of mechanical energy to the mixture of the dispersion medium, first type particles, second type particles and magnet type particles, with a specific power such that a particular average turbulent shear rate is achieved. The interrelation between the average turbulent shear rate and the agglomeration may be determined by experiments and test. These experiments or tests may form a basis for a look up table illustrating the interrelation between the average turbulent shear rate and the agglomeration. The latter being determined by the relative mass of first type particles (i.e. the recovery of first type particles or a specific property of the first type particles characteristic for the first type particles e.g. the content of a specific element) separated in step (B).

In this invention the term agglomeration relates to the mass of first particles that are attached to magnetic particles within step (A) and that are separated by application of a magnetic field in step (B). Thus, the agglomeration can be measured by determining the mass of first particles separated in step (B). The amount of first particles is usually determined by measuring a specific property of the first particles that correlates monotonously with the mass of the first particles. Typically such properties can be the content of a specific element (e.g. in the case of ore particles the target element of this ore) mineral or other compound or other properties e.g. optical properties like color numbers magnetic properties like the magnetic susceptibility or other physical properties like the density of the first particles.

Thus it is possible to improve the agglomeration of first type particles to magnet type particles by applying an amount of mechanical energy to the mixture of the dispersion medium, first type particles, second type particles and magnet type particles, until a sufficient high agglomeration is achieved that results in a high recovery of first type particles in step (B).

For providing the first type particles and the second type particles e.g. a raw ore material is milled to gain a desired particle size. The raw ore is for example milled to gain a predefined particle size. The particles can be distinguished between particles containing valuable material and particles which do not contain valuable material, but e.g. gangue or waste material. The particles can also be distinguished between particles containing valuable material content above a predefined threshold and particles containing valuable material content below this predefined threshold. The particles of a milled ore containing the valuable material may be the first type particles and the particles of a milled ore not containing the valuable material (or content below the predefined threshold) may be the second type particles. The ore to be milled may be a Copper Molybdenum CuMo and/or Copper Gold CuAu ore. The valuable particles correspondingly may include CuMo and/or CuAu. Valuables are comprised mostly of Chalcopyrite with some pyirite, Bornite, Chalcocite, Molybdenite, Arsenopyrite, Sphalerite, Covellite, Enargite, among other associated minerals. However the ore to be milled may also be a Ni, Zn, Pb and/or Co ore, a Ni-, Zn-, Pb- or Co-based ore and/or a PGM ore. Having stated this as the typical application of the present invention it is not excluded to apply the inventive technology in an inverse mode i.e. that the process is run so that the undesired material which may be a kind of an impurity is selectively attached to the magnetic particles and separated by application of a magnetic field.

The at least one second material or at least one second type particle may be any undesired material. In a preferred embodiment, the at least one second material is a hydrophilic material. In one embodiment, the at least one second material is a hydrophilic metal compound or a hydrophilic semimetal compound. In one embodiment, the at least one second material comprises oxidic metal or semimetal compounds, carbonate comprising metal or semimetal compounds, silicate comprising metal or semimetal compounds, sulfidic metal or semimetal compounds, hydroxidic metal or semimetal compounds or mixtures thereof. Typical oxidic metal or semimetal compounds which may be present as the at least one second material according to the invention include, but are not limited to, silicon dioxide ($SiO_2$), silicates, aluminosilicates, such as feldspars, albite ($Na(Si_3Al)O_8$), mica, for example muscovite ($KAl_2[(OH,F)_2AlSi_3O_{10}]$), garnets ($(Mg, Ca, Fe^{II})_3(Al, Fe^{III})_2(SiO_4)_3$ and further related minerals and mixtures thereof.

In one embodiment of the method according to the invention, the at least one second material is selected from the group consisting of $SiO_2$, CaO, $Al_2O_3$, MgO, $P_2O_3$, $ZrO_2$, $Fe_2O_3$, $Fe_3O_4$, $CeO_2$, $Cr_2O_3$, complex oxide matrices and mixtures thereof.

Accordingly, in a preferred embodiment of the present invention the at least one first material or at least one first type particle and the at least one second material or the at least one second type particle may comprise untreated ore and/or ore mineral mixtures obtained from mines.

In a further embodiment of the present invention, the at least one the at least one first material or at least one first type particle and the at least one second material or the at least one second type particle comprises slag, for example smelter slag or furnace slag. These materials are in general known to the skilled artisan. In a preferred embodiment, the slag may be furnace slag resulting from processing concentrates from platinum group metals (PGMs) bearing ores, spent catalyst materials or mixtures thereof.

As used herein, the term "slag" or "artificially prepared slag" or "metallurgical slag" refers to the by-product of a smelting process.

The main use of a smelting process is to convert an ore, scrap or a material mixture containing different metals into a form from which the desired metals can be skimmed as a metal layer and the undesired metal oxides, e.g. silicates, alumina, etc., remain as the slag. During smelting, a silicate-rich liquid phase may separate from the heavier metal melt. The latter is flowing through dedicated openings in the melting vessel and is further processed. The phase separation is however not complete, but a fraction of the desired metal becomes trapped in the liquid slag phase and remains dispersed there after solidification resulting in a so-called "mixing layer".

In general, one can distinguish between oxidative and reductive smelter operation. The slag material that can be separated according to the present invention can either be obtained under reductive conditions or can be obtained under oxidative conditions. For example, slag produced in PGM recovery operations, for example in Pt mines or old catalyst reprocessing etc., is usually formed under reducing conditions, which are exemplarily explained in the following. The energy needed to heat the mass to beyond the melting point is in general provided by an external heating, e.g. gas burners, or an electric arc. Often, carbon or other reducing materials are added. The goal is to reduce noble metal compounds to metal state. Reduced metals and the oxidic phase are immiscible and demix. Slags produced under reductive conditions often contain residual PGMs as free metals or alloys with other transition metals, particularly iron. These alloys are often ferromagnetic and can be separated from the slag matrix by a magnetic field after liberation. The losses of PGM into slag are almost exclusively due to incomplete demixing of the liquid metal and liquid slag phases—no significant formation of PGM solid solution in the slag occurs.

In a smelter that is operated under reductive conditions, the most base metal sulphides remain as sulphides. Some metal species, e.g. PGMs, may also remain as the native metal or tend to migrate into the magnetic fraction. Magnetite is often fed into the smelter to support the formation of the slag. Platinum and also rhodium preferably feature this behaviour to migrate to the magnetic fraction thus after the smelting process these precious group metals are hidden in the magnetic fraction, which is preferably in the slag, as dopants.

Is a smelter operated under oxidative conditions, the base metals sulphides and also some native metals compounds are oxidized. In this case, the magnetic separation process according to the present invention rarely be used without pre-treatment. However, if a surface treatment, for example a selective sulphidization of the desired metal of value, is preferably executed, the magnetic separation process according to the present invention can be employed as described herein. Besides the preferred sulphidization, also other surface treatments can be used to convert the desired metal species into a sulphidic, native or magnetic form. These treatments are known to the skilled artisan.

In a preferred embodiment, a dispersion medium comprises slag, and preferably furnace slag, which is obtained from smelting processes known to the skilled artisan, for example smelting processes to obtain metals such as Mo, Cu, Ni, Ag, Hg, Au, Pt, Pd, Rh, Ru, Ir, Os or mixtures thereof.

In a preferred embodiment, the dispersion medium comprising the at least one first material or at least one first type particle and the at least one second material or the at least one second type particle comprises furnace slag. Said furnace slag may be obtained as a product, for example an end-product, a by-product and/or as a waste-product of smelting processes.

In a preferred embodiment of the present invention, the dispersion medium comprising the at least one first material or at least one first type particle and the at least one second material or the at least one second type particle comprises smelter slag, wherein preferably the smelter slag is obtained from the mixing layer.

In one embodiment, the dispersion medium comprising the at least one first material or at least one first type particle and the at least one second material or the at least one second type particle comprises furnace slag comprising at least one valuable matter and from 5 to 80% by weight $SiO_2$, from 20 to 50% by weight CaO, from 0 to 60% by weight $Al_2O_3$, from 0 to 10% by weight MgO, from 0 to 10% by weight $P_2O_5$, from 0 to 10% by weight $ZrO_2$, from 0 to 10% by weight $Fe_2O_3$, and optionally other iron oxides, from 0 to 10% by weight $CeO_2$, and optionally other components, wherein the % are based on the total weight of the furnace slag.

In another preferred embodiment, the dispersion medium comprising the at least one first material or at least one first type particle and the at least one second material or the at least one second type particle comprises slag containing at least one valuable matter in an amount of from 0.01 to 1000 g/t or from 0.01 to 500 g/t slag. Slag materials containing the desired least one first material or at least one first type particle matter in lower or higher amounts are also within the scope of the present invention.

According to a particularly preferred embodiment of the present invention, the dispersion medium comprises slag comprising at least one first type material or particle selected from Ag, Au, Pt, Pd, Rh, Ru, Ir, Os, Zn, Pb, Te, Sn, Hg, Re, V or Fe and/or the base metals sulphides of Cu, Mo, Ni and Mn or others in an amount of from 0.01 to 1000 g/t slag.

In a preferred embodiment, the dispersion medium comprising the at least one first material or at least one first type particle and the at least one second material or the at least one second type particle comprises ore-bearing slag and/or wet ore tailings.

In general, the at least one magnetic particle of the method according to the present invention may be any magnetic particle.

In a preferred embodiment, the at least one magnetic particle is selected from the group consisting of magnetic metals, preferably iron and its alloys, cobalt, nickel and mixtures thereof; ferromagnetic or ferrimagnetic alloys of magnetic metals, for example NdFeB, SmCo and mixtures thereof; magnetic iron oxides, for example magnetite, magnetic hematite, hexagonal ferrites; cubic ferrites of the general formula (II)

$$M^{2+}_{x}Fe^{2+}_{1-x}Fe^{3+}_{2}O_4 \quad \text{(II)}$$

where

M is selected from Co, Ni, Mn, Zn and mixtures thereof and x is $\leq 1$;

and Strontium or Barium ferrites and mixtures thereof.

In a particularly preferred embodiment, the at least one magnetic particle is magnetite. Magnetite is known to the skilled artisan and is commercially available, e.g. as magnetic pigment 345 (BASF SE) or magnetite from LKAB Minerals AB, Rana Gruber AS, Höganäs AB. Furthermore, processes for the preparation of magnetite are known to those skilled in the art.

The at least one magnetic particle that is used in accordance with the present invention has in general an average diameter that enables this particle to efficiently agglomerate with the first type particles. In a preferred embodiment, the magnetic particle has a $d_{80}$ of from 1 nm to 10 mm, and preferably of from 0.1 μm to 100 μm and most preferred in the range between 1 μm and 20 μm. The wording "$d_{80}$" is known the skilled artisan and means that 80% by weight of the corresponding particles have a diameter that is smaller than the mentioned value. The particle size of the magnetite can be reduced prior use by grinding or milling. Methods for analyzing the diameter of the magnetic particles or other particles that are used or treated according to the present invention are known to the skilled artisan. Such methods for example include Laser Diffraction Measurement, in particular Laser Diffraction Measurement using a Mastersizer 2000 with software version 5.12G, wherein the sample is dispersed in an aqueous solution of $Na_4P_2O_7$.

In general, the amount of at least one magnetic particle to be applied in the method of the present invention can be determined by a person having ordinary skill in the art in a way that advantageously the whole amount of the at least one first type particles can be separated by agglomerating with the magnetic particles. In a preferred embodiment of the method according to the present invention, the magnetic particles are added in an amount of from 0.01 to 100% by weight, preferably from 0.1 to 20% by weight, particularly preferably from 0.5 to 10% by weight and most preferably 1 to 5% based on the weight of the dry at least one first type particles and the at least one second type particle.

In one preferred embodiment, the magnetic particle is a hydrophobic magnetic particle. In a preferred embodiment, the at least one magnetic particle is hydrophobized on its surface, i.e. is a hydrophobized magnetic particle. In a more preferred embodiment, the at least one magnetic particle has been hydrophobized by treatment with a hydrophobizing agent, wherein preferably the magnetic particle treated with the hydrophobizing agent has a contact angle between the particle surface and water against air of preferably more than 30°, more preferably more than 60°, even more preferably more than 90° and particularly preferably more than 140°.

In general, the hydrophobizing agent may be any agent that will render the surface of the magnetic particle more hydrophobic than the surface of the magnetic particle before the treatment.

In one embodiment, the hydrophobizing agent for hydrophobizing the at least one magnetic particle is a compound of the general formula (III) or derivative thereof $$[(B)_e—(Y)_f]_g \quad \text{(III)},$$

wherein each B is independently selected from among linear or branched $C_1$-$C_{30}$-alkyl, $C_1$-$C_{30}$-heteroalkyl, optionally substituted $C_6$-$C_{30}$-aryl, optionally substituted $C_6$-$C_{30}$-heteroalkyl, $C_6$-$C_{30}$-aralky;

and each Y is independently selected as a group by means of which the compound of the general formula (III) binds to the at least one magnetic particle;

each e is the integer 1, 2, 3, 4, 5, 6, 7, 8, 9 or 10;

each f is the integer 1, 2, 3, 4, 5, 6, 7, 8, 9 or 10; and each g is the integer 1, 2, 3, 4, 5, 6, 7, 8, 9 or 10 to 100.

In a particularly preferred embodiment, B is a linear or branched $C_6$-$C_{18}$-alkyl, preferably linear $C_8$-$C_{12}$-alkyl and very particularly preferably a linear $C_{12}$-alkyl.

In a further particularly preferred embodiment, Y is selected from the group consisting of $—(X)_p—Si(R^2)_3$, $—(X)_p—SiH(R^2)_2$, $—(X)_pSiH_2R^2$ wherein each $R^2$ is independently selected from F, Cl, Br, I or OH; and anionic groups such as

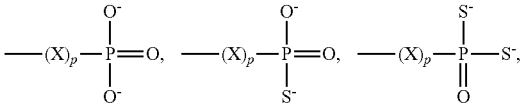

-continued

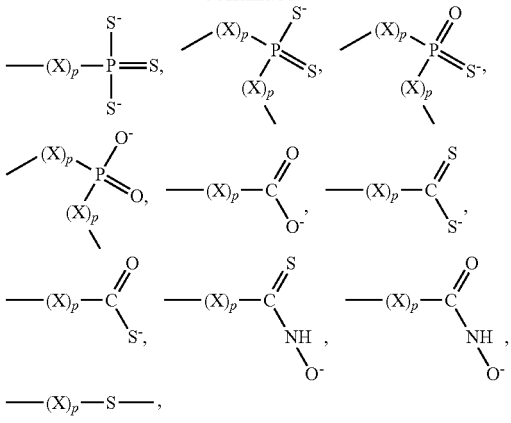

wherein each X is independently O, S, NH, or $CH_2$ and p is 0, 1 or 2.

Very particularly preferred hydrophobizing agents of the general formula (III) are silicon-based oils or siloxanes resulting from in-situ hydrolysis of dodecyl- or other alkyltrichlorosilanes or alkyltrialkoxysilanes; phosphonic acids, for example octylphosphonic acid; carboxylic acids; for example lauric acid, oleic acid or stearic acid; partly polymerized siloxanes (also known as silicon oils), or mixtures thereof.

In a preferred embodiment, the hydrophobizing agent is a compound as disclosed in WO 2012/140065.

Further preferred hydrophobizing agents are mono-, oligo- or polysiloxanes with free OH groups, such as the compounds of formula (IIIa), (IIIb) and (IIIc) or derivatives thereof, (IIIa)

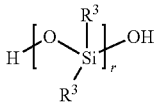

(IIIb)

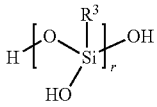

(IIIc)

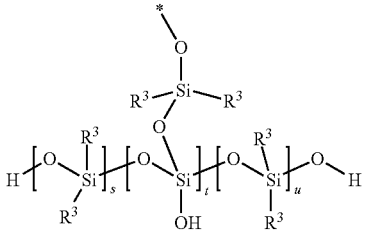

wherein each r, s, t, and u is independently an integer from 1 to 100, and each $R^3$ is independently a straight or branched $C_1$-$C_{12}$ alkyl group.

In formula (IIIc),* denotes a bonding to further moieties comprising $—SiOR_4$ and wherein $R^4$ is selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$- heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl.

In a preferred embodiment, the hydrophobizing agents of formula (IIIa), (IIIb) or (IIIc) have a molecular weight from about 250 to about 200000 g/mol, preferably from about 250 to about 20000 g/mol and particularly preferably from about 300 to about 5000 g/mol.

According to a preferred embodiment, the hydrophobizing agent is a compound of the general formulas (IV), (IVa), (IVb), (IVc) or derivatives thereof $$R^5_v\text{—}Si(OR^6)_{4-v} \quad \text{(IV)}$$

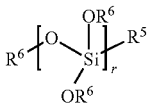

(IVa)

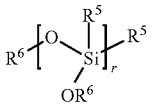

(IVb)

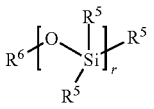

(IVc)

wherein each $R^5$ is independently selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$-heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl;

each $R^6$ is independently selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$-heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl, and the integer r is as described above and v is the integer 1, 2 or 3.

Preference is given to the radicals $R^5$ each being, independently of one another, linear or branched, optionally substituted $C_1$-$C_{30}$-alkyl, particularly preferably $C_1$-$C_{20}$-alkyl, very particularly preferably $C_4$-$C_{12}$-alkyl. In a preferred embodiment, $R^5$ is linear or branched, unsubstituted $C_1$-$C_{30}$-alkyl, particularly preferably $C_1$-$C_{20}$-alkyl or very particularly preferably $C_4$-$C_{12}$-alkyl. Examples of linear or branched $C_4$-$C_{12}$-alkyl radicals are butyl, in particular, n-butyl, isobutyl, tert-butyl; pentyl, in particular n-pentyl, isopentyl, tert-pentyl; hexyl, in particular n-hexyl, isohexyl, tert-hexyl, heptyl; in particular n-heptyl, isoheptyl, tert-heptyl; octyl in particular n-octyl, isooctyl, tert-octyl; nonyl, in particular n-nonyl, isononyl, tert-nonyl, decyl, in particular n-decyl, isodecyl, tert-decyl, undecyl, in particular n-undecyl, isoundecyl, tert-undecyl, or dodecyl, in particular n-dodecyl; isododecyl or tert-dodecyl.

Further preference is given to the radicals $R^5$ each being, independently of one another, linear or branched, optionally substituted $C_2$-$C_{30}$-alkenyl, particularly preferably $C_2$-$C_{20}$-alkenyl, very particularly preferably or $C_2$-$C_{12}$-alkenyl. Examples of alkenyl radicals which are particularly preferred according to the invention are ethenyl (vinyl), propenyl, in particular n-propenyl, isopropenyl, butenyl, in particular n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl and tert-dodecenyl.

Further preference is given to the radicals $R^5$ each being, independently of one another, linear or branched, optionally substituted $C_2$-$C_{30}$-alkynyl, particularly preferably $C_2$-$C_{20}$-alkynyl, very particularly preferably $C_2$-$C_{12}$-alkynyl. Examples of alkynyl radicals which are particularly preferred according to the invention are ethynyl, propynyl, in particular n-propynyl, isopropynyl, butynyl, in particular n-butynyl, isobutynyl, tert-butynyl, pentynyl, in particular n-pentynyl, isopentynyl, tert-pentynyl, hexynyl, in particular n-hexynyl, isohexynyl, tert-hexynyl, heptynyl, in particular n-heptynyl, isoheptynyl, tert-heptynyl, octynyl, in particular n-octynyl, isooctynyl, tert-octynyl, nonynyl, in particular n-nonynyl, isononynyl, tert-nonynyl, decynyl, in particular n-decynyl, isodecynyl, tert-decynyl, undecynyl, in particular n-undecynyl, isoundecynyl, tert-undecynyl, or dodecynyl, in particular n-dodecynyl, isododecynyl and tert-dodecynyl.

Further preference is given to the radicals $R^5$ each being, independently of one another, optionally substituted $C_3$-$C_{20}$-cycloalkyl, particularly preferably $C_3$-$C_{12}$-cycloalkyl, very particularly preferably $C_3$-$C_6$-cycloalkyl, such as cyclopropyl, cyclobutyl, cyclopentyl or cyclohexyl.

Further preference is given to the radicals $R^5$ each being, independently of one another, optionally substituted $C_3$-$C_{20}$-cycloalkenyl, particularly preferably $C_3$-$C_{12}$-cycloalkenyl, very particularly preferably $C_3$-$C_6$-cycloalkenyl such as cyclopropenyl, cyclobutenyl, cyclopentenyl or cyclohexenyl.

Further preference is given to the radicals $R^5$ each being, independently of one another, optionally substituted $C_1$-$C_{20}$-heteroalkyl, particularly preferably $C_1$-$C_{12}$-heteroalkyl. The heteroalkyl radicals present according to the invention are derived from the abovementioned alkyl radicals, with at least one carbon atom being replaced by a heteroatom selected from among N, O, P and S.

Further preference is given to the radicals $R^5$ each being, independently of one another, optionally substituted $C_5$-$C_{22}$-aryl, particularly preferably $C_5$-$C_{12}$-aryl. Examples of aryl radicals which are preferred according to the invention are phenyl, naphthyl or biaryls.

Further preference is given to the radicals $R^5$ each being, independently of one another, optionally substituted $C_6$-$C_{23}$-alkylaryl, particularly preferably $C_6$-$C_{13}$-alkylaryl. An example of an alklaryl radical which is preferred according to the invention is benzyl.

Further preference is given to the radicals $R^5$ each being, independently of one another, optionally substituted $C_6$-$C_{23}$-arylalkyl, particularly preferably $C_6$-$C_{13}$-arylalkyl. Examples of arylalkyl radicals which are preferred according to the invention are tolyl, xylyl, propylbenzyl or hexylbenzyl.

Further preference is given to the radicals $R^5$ each being, independently of one another, optionally substituted $C_5$-$C_{22}$-heteroaryl, particularly preferably $C_5$-$C_{12}$-heteroaryl.

The abovementioned radicals $R^5$ can optionally be substituted. Suitable substituents are, for example, selected from among amino, amido, imido, hydroxyl, ether, aldehyde, keto, carboxylic acid, thiol, thioether, hydroxamate and carbamate groups. The abovementioned radicals $R^5$ can be mono- or poly-substituted. In the case of multiple substitutions, one substituent group can be present a plurality of times or various functional groups are simultaneously present. The radicals mentioned for $R^5$ can also be monosubstituted or polysubstituted by the abovementioned alkyl, alkenyl, alkynyl, aryl, alkylaryl, arylalkyl, heteroalkyl or heteroaryl radicals.

Very particularly preferred radicals $R^5$ are octyl, in particular n-octyl; hexyl, in particular n-hexyl; and/or butyl, in particular n-butyl; decyl, in particular n-decyl; or dodecyl, in particular n-dodecyl.

Preference is given to the radicals $R^6$ each being, independently of one another, hydrogen, linear or branched, optionally substituted $C_1$-$C_{30}$-alkyl, particularly preferably $C_1$-$C_{20}$-alkyl, very particularly preferably $C_1$-$C_{12}$-alkyl. In a preferred embodiment, $R^6$ is linear or branched, unsubstituted $C_1$-$C_{30}$-alkyl, particularly preferably $C_1$-$C_{20}$-alkyl, or very particularly preferably $C_1$-$C_{12}$-alkyl. Examples of linear or branched $C_1$-$C_{12}$-alkyl radicals are methyl, ethyl, propyl, in particular n-propyl, isopropyl, butyl, in particular n-butyl, isobutyl, tert-butyl, pentyl, in particular n-pentyl, isopentyl, tert-pentyl, hexyl, in particular n-hexyl, isohexyl, tert-hexyl, heptyl, in particular n-heptyl, isoheptyl, tert-heptyl, octyl, in particular n-octyl, isooctyl, tert-octyl, nonyl, in particular n-nonyl, isononyl, tert-nonyl, decyl, in particular n-decyl, isodecyl, tert-decyl, undecyl, in particular n-undecyl, isoundecyl, tert-undecyl, or dodecyl, in particular n-dodecyl, isododecyl or tert-dodecyl.

Further preference is given to the radicals $R^6$ each being, independently of one another, linear or branched, optionally substituted $C_2$-$C_{30}$-alkenyl, particularly preferably $C_2$-$C_{20}$-alkenyl and very particularly preferably $C_2$-$C_{12}$-alkenyl. Examples of alkynyl radicals which are particularly preferred according to the invention are ethenyl (vinyl), propenyl, in particular n-propenyl, isopropenyl, butenyl, in particular n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl or tert-dodecenyl.

Further preference is given to the radicals $R^6$ each being, independently of one another, linear or branched, optionally substituted $C_2$-$C_{30}$-alkynyl, particularly preferably $C_2$-$C_{20}$-alkynyl or very particularly preferably $C_2$-$C_{12}$-alkynyl. Examples of alkynyl radicals which are particularly preferred according to the invention are ethynyl, propynyl, in particular n-propynyl, isopropynyl, butynyl, in particular n-butynyl, isobutynyl, tert-butynyl, pentynyl, in particular n-pentynyl, isopentynyl, tert-pentynyl, hexynyl, in particular n-hexynyl, isohexynyl, tert-hexynyl, heptynyl, in particular n-heptynyl, isoheptynyl, tert-heptynyl, octynyl, in particular n-octynyl, isooctynyl, tert-octynyl, nonynyl, in particular n-nonynyl, isononynyl, tert-nonynyl, decynyl, in particular n-decynyl, isodecynyl, tert-decynyl, undecynyl, in particular n-undecynyl, isoundecynyl, tert-undecynyl, or dodecynyl, in particular n-dodecynyl, isododecynyl or tert-dodecynyl.

Further preference is given to the radicals $R^6$ each being, independently of one another, optionally substituted $C_3$-$C_{20}$-cycloalkyl, particularly preferably $C_3$-$C_{12}$-cycloalkyl and particularly preferably $C_3$-$C_6$-cycloalkyl, for example cyclopropyl, cyclobutyl, cyclopentyl or cyclohexyl.

Further preference is given to the radicals $R^6$ each being, independently of one another, optionally substituted $C_3$-$C_{20}$-cycloalkenyl, particularly preferably $C_3$-$C_{12}$-cycloalkenyl and very particularly preferably $C_3$-$C_6$-cycloalkenyl, for example cyclopropenyl, cyclobutenyl, cyclopentenyl or cyclohexenyl.

Further preference is given to the radicals $R^6$ each being, independently of one another, optionally substituted $C_1$-$C_{20}$-heteroalkyl, particularly preferably $C_4$-$C_{12}$-heteroalkyl. The heteroalkyl radicals which are present according to the invention are derived from the abovementioned alkyl radicals, with at least one carbon atom being replaced by a heteroatom selected from among N, O, P and S.

Further preference is given to the radicals $R^6$ each being, independently of one another, optionally substituted $C_5$-$C_{22}$-aryl, particularly preferably $C_5$-$C_{12}$-aryl. Examples of aryl radicals which are preferred according to the invention are phenyl, naphthyl or biaryls.

Further preference is given to the radicals $R^6$ each being, independently of one another, optionally substituted $C_6$-$C_{23}$-alkylaryl, particularly preferably $C_6$-$C_{13}$-alkylaryl. An example of an alkylaryl radical which is preferred according to the invention is benzyl.

Further preference is given to the radicals $R^6$ each being, independently of one another, optionally substituted $C_6$-$C_{23}$-arylalkyl and particularly preferably $C_6$-$C_{13}$-arylalkyl. Examples of arylalkyl radicals which are preferred according to the invention are tolyl, xylyl, propylbenzyl or hexylbenzyl.

Further preference is given to the radicals $R^6$ each being, independently of one another, optionally substituted $C_5$-$C_{22}$-heteroaryl and particularly preferably $C_5$-$C_{12}$-heteroaryl.

The abovementioned radicals $R^6$ may optionally be substituted. Suitable substituents are, for example, selected from among amino, amido, imido, hydroxy, ether, aldehyde, keto, carboxylic acid, thiol, thioether, hydroxamate and carbamate groups. The abovementioned radicals $R^6$ can be mono- or poly substituted. In the case of multiple substitutions, one substituent can be present a plurality of times or various functional groups are simultaneously present. The radicals mentioned for $R^6$ can also be monosubstituted or polysubstituted by the abovementioned alkyl, alkenyl, alkynyl, aryl, alkylaryl, arylalkyl, heteroalkyl or heteroaryl radicals.

In another preferred embodiment, the at least one hydrophobizing agent is selected from the group consisting of $(NaO)(CH_3)Si(OH)_2$, $(NaO)(C_2H_5)Si(OH)_2$, $(NaO)(C_5H_{11})Si(OH)_2$, $(NaO)(C_8H_{17})Si(OH)_2$, $(KO)(CH_3)Si(OH)_2$, $(KO)(C_2H_5)Si(OH)_2$, $(KO)(C_5H_{11})Si(OH)_2$, $(KO)(C_8H_{17})Si(OH)_2$, $(NH_4O)(CH_3)Si(OH)_2$, $(NH_4O)(C_2H_5)Si(OH)_2$, $(NH_4O)(C_5H_{11})Si(OH)_2$, $(NH_4O)(C_8H_{17})Si(OH)_2$, $(NaO)_2(CH_3)Si(OH)$, $(NaO)_2(C_2H_5)Si(OH)$, $(NaO)_2(C_5H_{11})Si(OH)$, $(NaO)_2(C_8H_{17})Si(OH)$, $(KO)_2(CH_3)Si(OH)$, $(KO)_2(C_2H_5)Si(OH)$, $(KO)_2(C_5H_{11})Si(OH)$, $(KO)_2(C_8H_{17})Si(OH)$, $(NH_4O)_2(CH_3)Si(OH)$, $(NH_4O)_2(C_2H_5)Si(OH)$, $(NH_4O)_2(C_5H_{11})Si(OH)$, $(NH_4O)_2(C_8H_{17})Si(OH)$, $(NaO)_3(CH_3)Si$, $(NaO)_3(C_2H_5)Si$, $(NaO)_3(C_5H_{11})Si$, $(NaO)_3(C_8H_{17})Si$, $(KO)_3(CH_3)Si$, $(KO)_3(C_2H_5)Si$, $(KO)_3(C_5H_{11})Si$, $(KO)_3(C_8H_{17})Si$, $(NH_4O)_3(CH_3)Si$, $(NH_4O)_3(C_2H_5)Si$, $(NH_4O)_3(C_5H_{11})Si$, $(NH_4O)_3(C_8H_{17})Si$, $(NaO)(CH_3)_2Si$ (OH), $(NaO)(C_2H_5)_2Si(OH)$, $(KO)(CH_3)_2Si(OH)$, $(KO)(C_2H_5)_2Si(OH)$, $(NaO)_2(CH_3)_2Si$, $(NaO)_2(C_2H_5)_2Si$, $(KO)_2(CH_3)_2Si$, $(KO)_2(C_2H_5)_2Si$, $Ca^{2+}[(O^-)(CH_3)Si(OH)_2]_2$, $Ca^{2+}[(O^-)(C_2H_5)Si(OH)_2]_2$, $Ca^{2+}[(O^-)(C_5H_{11})Si(OH)_2]_2$, $Ca^{2+}[(O^-)(C_8H_{17})Si(OH)_2]_2$, $Ca^{2+}[(O^-)(CH_3)_2Si(OH)]_2$, $Ca^{2+}[(O^-)(C_2H_5)_2Si(OH)]_2$, $Ca^{2+}[(O^-)_2(CH_3)Si(OH)]$, $Ca^{2+}[(O^-)_2(C_2H_5)Si(OH)]$, $Ca^{2+}[(O^-)_2(C_5H_{11})Si(OH)]$, $Ca^{2+}[(O^-)_2(C_8H_{17})Si(OH)]$, $Ca^{2+}[(O^-)_2(CH_3)_2Si]$, $Ca^{2+}[(O^-)_2(C_2H_5)_2Si]$ and combinations thereof.

In one embodiment, the at least one hydrophobizing agent is added to the first dispersion in step (A).

In another preferred embodiment, the at least one magnetic particle has been pre-treated with the at least one hydrophobizing agent before the contacting of dispersion I in step (A).

A dispersion medium may be water. Water is appropriate as it is of low cost and almost always and everywhere available. It should be noted that also other suitable liquids may be used as dispersion medium. First type particles and second type particles with magnet type particles may be mixed with water as dispersion medium, so that in the dispersion medium first type particles may agglomerate to magnet type particles to obtain magnetic agglomerates. The mixture of the dispersion medium, the first type particles, the second type particles and the magnet type particles may be a dispersion.

As used herein, the term "dispersion" refers to material comprising more than one phase wherein at least one of the phases consists of finely divided phase domains, often in the colloidal size range, dispersed throughout a continuous phase.

Contacting in a dispersion medium first or second type particles with magnet type particles includes direct contact as well as indirect contact. Indirect contact may also include an adhesion based on an interaction. The interaction may include, but not limited to a hydrophobic interaction and a charge based interaction.

The at least one first type particles may be treated with a collector.

As used herein, the term "collector" refers to a compound that selectively forms a hydrophobic layer on a given valuable matter containing material such as a mineral surface. Collectors are typically known for their use in flotation processes. A collector may be an ionizing collector, such as a cationic collector or an anionic collector; or a non-ionizing collector. The term "ionizing" as used in "ionizing collector" refers to a collector that dissociates in water in at least two groups, such as in a cation and an anion. The term "anionic collectors" refers to collectors wherein the anionic part forms the hydrophobic layer on a given mineral. The term "cationic collector" refers to a collector wherein the cationic part forms a hydrophobic layer on a given mineral surface. The term "non-ionizing collector" refers to collectors which are usually liquid, non-polar hydrocarbons that do not dissociate in water.

Examples of anionic collectors include, but are not limited to, oxyhydryl collectors such as carboxylates, alkyl sulfates, sulfonates, hydroxamates, sulfosuccinates and sulfosuccinamates, phosphonic acid derivatives, phosphoric acid ester, sulfhydryls, sulfur and nitrogen derivatives of carbonic acids, preferably xanthates, dithiophosphinates, trithiocarbonates and substituted mercaptobenzothiozoles and dithiophosphates.

Examples of cationic collectors include, but are not limited to, compounds comprising at least one primary, secondary, tertiary or quaternary amine such as fatty amines or ether amines.

Examples of non-ionizing collectors include, but are not limited to, kerosene, transformer oils and synthetic hydrocarbon oils.

Further, collectors may also have a polymeric structure such as the polymers described in WO 2013/038192 A1.

Non-limiting examples of collectors are also found in the collector handbook of floating agents: chemistry, theory and practice, Srdjan M. Balutovic, February 2008, Elsevier.

In one embodiment, the at least one first type particles have been treated with at least ionizing collector or non-ionizing collector or mixtures thereof.

In a preferred embodiment, the at least one first type particles have been treated with an ionizing collector, i.e. with a cationic or anionic collector.

In one embodiment, the at least one collector is a polymer, for example at least one of the polymers described in WO 2013/038192.

According to a preferred embodiment of the method according to the present invention, the at least one collector is a compound of the general formula (I) or derivative thereof $$[(A)_m(Z)_n]_o \quad (I)$$

wherein each A is independently selected from linear or branched $C_1$-$C_{30}$-alkyl, $C_2$-$C_{30}$-alkenyl $C_1$-$C_{30}$-heteroalkyl, optionally substituted $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which may be unsubstituted or optionally substituted;

and each Z is independently selected from anionic groups, cationic groups or non-ionic groups;

m is an integer number of 1, 2, 3, 4, 5, 6, 7, 8, 9 or 10;

n is an integer number of 1, 2, 3, 4, 5, 6, 7, 8, 9 or 10; and o is an integer number of 1, 2, 3, 4, 5, 6, 7, 8, 9 or 10 to 100.

It is understood that formula (I) includes all possible combinations of how each A and each Z may be attached to one another. This includes any linear attachment, such as in -A-A-Z—Z—, A-Z-A-Z—, —Z-A-Z-A- and the like; branched attachments, such as in

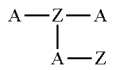

and the like; and circular attachments such as in

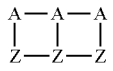

and the like. The skilled person is able to identify suitable attachment sites, such as substitution sites, in substituent A and Z that allow the attachment.

Furthermore, particularly preferred attachment sites are indicated in the respective definition of substituent Z.

In a particularly preferred embodiment, A is a linear or branched $C_1$-$C_{14}$-alkyl, and preferably a linear $C_4$-alkyl or $C_8$-alkyl.

In a further preferred embodiment, A is preferably a branched $C_1$-$C_{20}$-alkyl, particularly preferably a branched $C_6$-$C_{14}$-alkyl, wherein preferably at least one branch, preferably a branch having 1 to 6 carbon atoms, is attached in 2-position, such as in 2-ethylhexyl and/or 2-propylheptyl. Corresponding compounds being substituted in 2-position are, for example, obtained using the Guerbet reaction that is known to the skilled artisan as one reaction step.

In a preferred embodiment, Z is selected as an anionic group. Non-limiting examples of anionic groups are

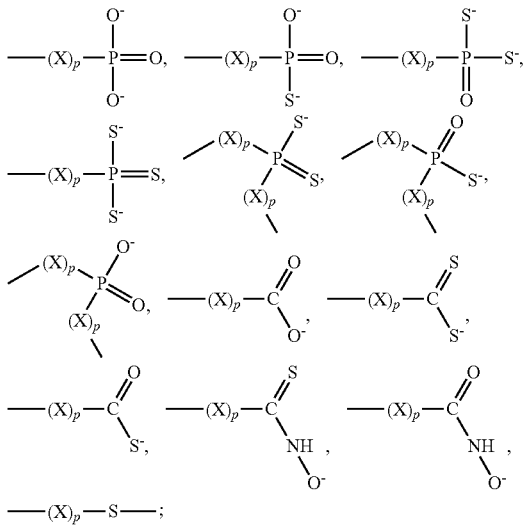

wherein each X is independently selected from the group consisting of O, S, NH, $CH_2$; and each p is independently selected from 0, 1 or 2.

In a preferred embodiment, the anionic group is present as a salt with at least one cation wherein preferably the at least one cationic counter ion is selected from the group consisting of hydrogen, $N(R^1)_4^+$; wherein each $R^1$ is independently selected from hydrogen, $C_1$-$C_8$-alkyl, hydroxy-substituted $C_1$-$C_8$-alkyl or $C_1$-$C_8$-heteroalkyl, preferably HO—$CH_2CH_2$— or HO—$CH_2CH_2$—O—$CH_2CH_2$—; alkali- or earth alkali metals, preferably sodium or potassium; or combinations thereof.

The negatively charged anionic groups may of course also be present in a protonated form, depending, for example, on the pH of the aqueous environment. For example, the —$(X)_p$—S— anion group may be present as a —$(X)_p$—SH neutral group.

In another preferred embodiment, Z is selected as a cationic group. Non-limiting examples of cationic groups include, but are not limited to,

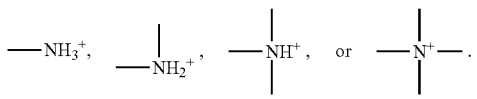

The cationic group may of course also be present in a deprotonated form, depending, for example, on the pH. For instance, —$NH_3^+$ may also be present as —$NH_2$.

In another preferred embodiment, Z is selected as a non-ionic group. Examples of non-ionic groups include, but are not limited to, —$X_A$—,

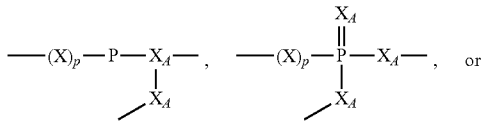

-continued

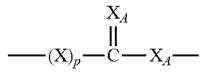

wherein each X is defined as indicated above and each $X_A$ is independently O or S.

In a preferred embodiment, the at least one collector is a compound of formula (IA) or derivative thereof $$A\text{-}Z_1\text{-}A \quad \text{(IA)}$$

wherein each A is selected as described above and wherein $Z_1$ is selected from the group consisting of

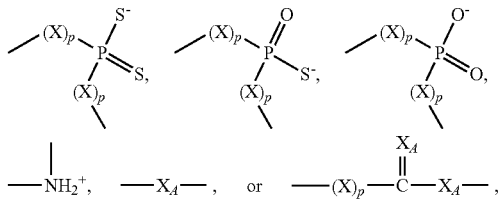

wherein X, $X_A$ and p are defined as described above.

In another preferred embodiment, the at least one collector is a compound of formula (IB) or derivative thereof $$A\text{-}Z_1\text{-}A\text{-}Z_2 \quad \text{(IB)}$$

wherein A and $Z_1$ are defined as described above and wherein $Z_2$ is selected from the group consisting of

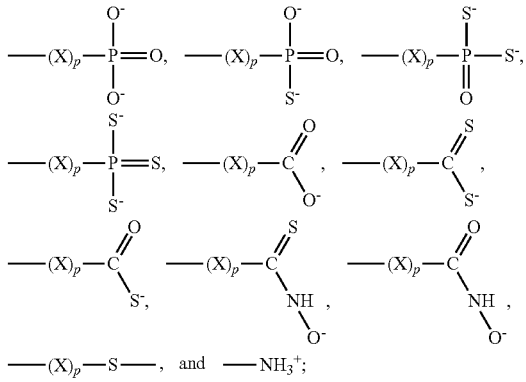

and wherein X and p are as defined above.

In yet another preferred embodiment, the at least one collector is a compound of formula (IC) or derivative thereof

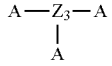

(IC)

wherein A is selected as defined above and wherein $Z_3$ is selected from the group consisting of

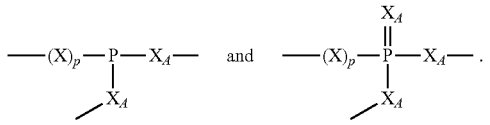

In yet another preferred embodiment, the at least one collector is a compound of formula (ID) or formula (IE),

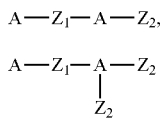

(ID)

(IE)

wherein A, $Z_1$, and $Z_2$ are defined as described above.

In yet another embodiment, the at least one collector is a compound of formula (IF) or (IG) or derivatives thereof

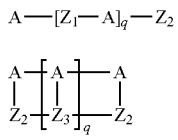

(IF)

(IG)

wherein q is an integer of 1, 2, 3, 4 or 5 to 100 and A, $Z_1$, $Z_2$ or $Z_3$ are defined as described above.

In a further preferred embodiment, the at least one collector is selected from (i) xanthates, preferably xanthates of formula (IH) or (IJ) or derivatives thereof

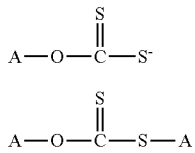

(IH)

(IJ)

(ii) dithiophosphates, preferably dithiophosphates of formula (IK) or derivatives thereof

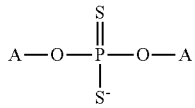

(IK)

(iii) dithiophosphinates, preferably dialkyldithiophosphinates of formula (IL) or derivatives thereof

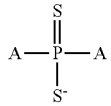

(IL)

(iv) dialkyldithiocarbamates, preferably dialkyldithiocarbamates of formula (IM) or derivatives thereof

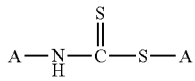

(IM)

or (v) alkyltrithiocarbamates preferably alkyltrithiocarbamates of formula (IN) or derivatives thereof

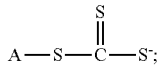

(IN)

or mixtures thereof, wherein each A is defined as described above. In a preferred embodiment, each A is independently selected from a group consisting of a linear or branched and preferably linear $C_6$-$C_{20}$-alkyl, more preferably n-octyl; or a branched $C_6$-$C_{14}$-alkyl, wherein the branch is preferably located in 2-position, for example 2-ethylhexyl and/or 2-propylheptyl.

In an especially preferred embodiment, the at least one collector is selected from the group consisting of sodium- or potassium-n-octylxanthate, sodium- or potassium-butylxanthate, sodium- or potassium-di-n-octyldithiophosphinate, sodium- or potassium-di-n-octyldithiophosphate, sodium- or potassium-di-n-octyldithiocarbamates, sodium- or potassium-ethyl-hexyl-xanthate and mixtures thereof.

In a particularly preferred embodiment, the at least one collector is selected from the group consisting of potassium-n-octyl xanthate (1:1 salt of carbonodithionic acid O-ocytyl ester) or potassium-di-n-octyldithiophosphinate or mixtures thereof.

In a preferred embodiment, at least one collector is used in an amount which is sufficient to achieve the desired effect. In a preferred embodiment, the at least one collector is added in an amount of from about 0.0001 to about 1% by weight and preferably from about 0.001 to about 0.1% by weight in each case based on the weight of total dry solid content.

In a conditioning procedure the already hydrophobized magnet type particles are brought into contact with the valuable, e.g. first type particles being hydrophobized by a collector. For the aforementioned hydrophobizing typically the collector concentration may be in the range of 10 to 1000 g/t of solid mass of the first type particles, the second type particles and the magnet type particles. The first type particles and the magnet type particles agglomerate upon defined mechanical energy input into the mixture of the dispersion medium, the first type particles, the second type particles and the magnet type particles. It should be noted that beside the above listed contents the mixture may also include further materials and/or contents. These additional materials may comprise any additive known by the skilled person to be used to improve the dispersion of the particles their surface charges and the chemical properties of the dispersing medium (e.g. the pH-value and the redox-potential).

The mechanical shear energy can be introduced into the dispersion by different means. Typically it is done by a stirred vessel that may contain baffles to render the energy up take more efficient. Other means are milling aggregates like ball mills or any type of stirred ball mills. Also the use of rotor stator mixing devices is possible. Provided the correct amount of energy can be introduced the turbulent flow of the dispersion through a pipe conveyed by pumps or by gravity will also yield the required agglomeration. Static mixers and counter current flow mixers are another way to introduce shear energy into the flowing dispersion of the first type particles, the second type particles and the magnet type particles.

Agglomeration may take place in an agglomeration volume for a batch process. In this case the mixture is put into the volume and e.g. stirred until the desired agglomeration is achieved. Thereafter the mixture is released from the agglomeration volume. Agglomeration may also take place in an agglomeration volume for a continuous flow process. In this case the mixture is continuously fed to and released from the volume containing the stirrer. The desired agglomeration can be controlled by controlling the feed rate to and from the stirring volume i.e. the average residence time of the dispersion in the stirred volume. At a given stirring power the average residence time determines the shear energy up-take of the suspension. It should be understood that a very high residence time and consequently very slow feeding and releasing may be not economically reasonable. For particular volumes of a batch or flow process there may be no significant difference with respect to agglomeration efficiency provided the shear energy up-take is similar.

The transfer of mechanical energy may be achieved by any device. For example the transfer of mechanical energy may be achieved by a single stirrer or stirrer arrangement. In addition or alternatively, the transfer of mechanical energy may be achieved by a flow generator, e.g. a pump, generating a turbulent flow in the mixing vessel by means of which turbulent flow the mechanical energy may be transferred into the mixture of the dispersion medium, first type particles, second type particles and magnet type particles.

The predefined particle sizes or particle size ranges referred to in this description relate to a d80 distribution, if not declared otherwise. This means that at least 80% in weight of the particles have a particle size of the referred range or smaller. If the particle size is 170 μm (d80), 80 weight % of all particles are 170 μm or smaller.

The magnetic agglomerates have magnetic properties, but the second type particles may not. In the case that the second type particles contain magnetic components these may be separated before performing step (A) of the present invention. Thus, the agglomerates and the second type particles can be separated by applying a magnetic field. It should be noted, that the separation of the magnetic agglomerates from second type particles by applying a magnetic field may result from the magnetic properties of the magnet type particles in the agglomerates as well as from magnetic properties of the first type particles.

This magnetic separation step can be repeated, in particular by repeated flow of the non-magnetic product of the foregoing separation step through a consecutive separation path or by modulating the magnetic field. In this consecutive separation steps (known in the art as scavenging) further amounts of magnetic particles may be added. The separated agglomerates can be stirred after a first separation and before a second separation, so that trapped second type particles can be set free and can be separated in the second separating step (known in the art as cleaning).

The magnetic separation may be conducted by any method known to the skilled artisan. In general, methods for separating magnetic parts as a magnetic fraction from a mixture comprising them and non-magnetic parts as the remaining non-magnetic fraction are known to the skilled artisan.

In a preferred embodiment, step (B) may be carried out with any magnetic equipment that is suitable to separate magnetic particles from dispersion, e. g. drum separators, high or low intensity magnetic separators, continuous belt type separators or others.

In another preferred embodiment, step (B) may be carried out by introducing a permanent magnet into the reactor in which the dispersion of step (A) is present. In a preferred embodiment, a dividing wall composed of non-magnetic material, for example the wall of the reactor, may be present between the permanent magnet and the mixture to be treated. In a further preferred embodiment of the method of the invention, an electromagnet is used in step (B) which is only magnetic when an electric current flows. Suitable apparatuses are known to those skilled in the art.

For example, suitable apparatus and methods of magnetic separation may be found in "Magnetic techniques for the treatment of materials", Jan Svoboda, Kluwer Academic Publishers, 2004.

In a preferred embodiment, the magnetic separation equipment allows washing the magnetic concentrate during separation with a dispersant, preferably water. The washing preferably allows removing inert material from the magnetic concentrate.

In a preferred embodiment, step (B) is conducted continuously or semi-continuously, wherein preferably the dispersion to be treated flows through a separator. Flow velocities of the dispersion to be treated are in general adjusted to obtain an advantageous yield of separated magnetic agglomerates. In a preferred embodiment, flow velocities of the dispersion to be treated are 10 mm/s to 1000 mm/s.

In a preferred embodiment the environment (water chemistry and temperature) is optimized to activate the surface of the first type particles to ensure efficient interaction between the surface of the first type particles and the collector molecules used. Details are known in the art and are described e.g. in Srdjan M. Bulatovic Handbook of Flotation Reagents Vol. 1 (2007), Vol. 2 (2010), Vol. 3 (2014).

The pH-value of the dispersion which is treated in step (B) may typically be from about 5 to about 13 and preferably from about 7 to about 12.

Step (A) of the method of the invention may be carried out at any suitable temperature. In a preferred embodiment, step (A) is carried out at a temperature from about 10 to about 60° C. and preferably at ambient temperature. Step (B) of the invention is typically performed at temperature equal or lower than the temperature employed in step (A).

In a preferred embodiment, step (B) is performed by a continuous or semi-continuous magnetic separation technology as described by e.g. Jan Svoboda "Magnetic Techniques for the Treatment of Materials" (2004) In an embodiment of this invention the magnetic separators are of the LIMS (low intensity magnetic separator), MIMS (medium intensity magnetic separator) or WHIMS (wet high intensity magnetic separator) type as known in the art. In an preferred embodiment of this invention the separators are of the MIMS or WHIMS type.

In another embodiment, the apparatus used for the magnetic separation according to step (B) of the present invention is an apparatus as disclosed in WO 2012/104292.

In another embodiment, the apparatus used for the magnetic separation according to step (B) of the present invention is an apparatus as disclosed in WO 2011/131411, WO 2011/134710, WO 2011/154178, DE 10 2010 023 130, DE 20 2011 104 707, WO 2011/107353, DE 10 2010 061 952, WO 2012/116909, WO 2012/107274 or WO 2013/167634.

As one preferred apparatus for the magnetic separation, the apparatus comprises at least one loop-like canal through which the dispersion flows.

In a preferred embodiment, the apparatus used in step (B) of the method according to the present invention for the magnetic separation comprises at least one loop-like canal through which the dispersion flows and which has at least two inlet and at least two outlets.

In one embodiment, the apparatus that is preferably used in step (B) of the method according to the present invention further comprises at least one magnet that is movable alongside the canal.

In one embodiment, the apparatus for the magnetic separation of the invention is operated in countercurrent i.e. the movement of the magnetic field is opposite to the direction of the suspension flow.

The magnets used according to the invention can be any magnets known to those skilled in the art, for example permanent magnets, electromagnets and combinations thereof. Permanent magnets are preferred, because the amount of energy that is consumed by the apparatus according to the invention may be essentially decreased compared to the use of electro magnets.

In a preferred embodiment, a multiplicity of magnets is arranged around the loop-like canal. In a preferred embodiment, the magnetic constituents present in the dispersion accumulate at least in part, preferably in their entirety, i.e. in a proportion of at least 60% by weight, preferably at least 90% by weight, particularly preferably at least 99% by weight, on the side of the loop-like canal facing the at least one magnet as a result of the magnetic field, wherein the % by weight is based on the total weight of magnetic constituents.

After having obtained the agglomerates by one or more steps of magnetic separation, the agglomerates may be dissociated into the first type particles and the magnet type particles. The dissociation of the agglomerates and the separation of the first particles from the magnetic particles are done in order to recycle the magnetic particles within the process and may be also done in cases where the magnetic particles may interfere with consecutive processing steps.

This can be achieved by adding a cleaving agent. When being dissociated the first type particles may be without magnetic properties, so that the first type particles can be separated from the magnet type particles by applying a magnetic field. As described above with respect to the separation of the agglomerates from the second type particles, also the separation of the first type particles and the magnet type particles can be done once or more a plural times, optionally with a stirring and de-trapping between separation steps.

The cleaving agent may comprise organic solvents, basic compounds, acidic compounds, oxidants, reducing agents, surfactants or mixtures thereof.

Examples of basic compounds which can be used according to the invention are aqueous solutions of basic compounds, for example aqueous solutions of alkali metal and/or alkaline earth metal hydroxides, such as KOH or NaOH; lime water, aqueous ammonia solutions, aqueous solutions of organic amines of the general formula $(R^7)_4N^+$, where each $R^7$ is selected independently from $C_1$-$C_8$-alkyl which may optionally be substituted.

Examples of surfactants which can be used according to the invention are nonionic, anionic, cationic and/or zwitterionic surfactants. In a preferred embodiment, the cleavage is made by the use of preferably biodegradable and/or nonionic surfactants in concentrations in the range of the critical micelle concentrations.

In a preferred embodiment, the addition product of the at first type particles and magnetic particles is cleaved by means of preferably biodegradable nonionic surfactants added in an amount of from 0.001 to 10% by weight, preferably from 0.01 to 1% by weight, based on the weight of the total liquid phase of suspension. The surfactant concentration is preferably at least more than its critical micelle concentration (CMC), more preferably at least twice as high as its CMC.

In a preferred embodiment, the cleaving agent comprises a mixture of water and surfactant.

As used herein, the term "canal" describes the body structure of an apparatus. According to the present invention the wording "canal" describes an apparatus, which is, in its easiest embodiment, formed by a tube, e. g. the canal according to the invention has a length that is larger than the breadth or diameter of the canal. The cross-section of the canal can have any suitable shape, for example oval, annular, circular, square, rectangular, irregular or a combination of these shapes, preferably square or rectangular.

As used herein, the term "loop-like" describes a canal, which, in a simple embodiment, is formed like a loop. In a preferred embodiment the loop-like canal forms a part of a circular arc, for example at least 90°, preferably at least 120°, more preferably at least 180°, in particular at least 270°, of a circular arc.

A suitable energy level for conditioning finer particles lies well above the ones for coarser particles.

As larger particles have a higher inertness, the shear resistivity of agglomerates of larger particles is lower than the shear resistivity of agglomerates of smaller particles. Consequently different energy levels are required for different particle sizes.

Shear is here characterized by the average velocity gradient "G" assuming homogeneous turbulence as:

$$G = \sqrt{\frac{\varepsilon}{\nu}}$$

where ε is the energy dissipation rate per unit mass of slurry and ν is the kinematic viscosity of the slurry.

According to an embodiment of the invention the transferred energy is shear energy and/or deformation energy transferred by stirring the mixture of the dispersion medium, first type particles, second type particles and magnet type particles.

Thus the energy can be input into the mixture of the dispersion medium, first type particles, second type particles and magnet type particles by a mechanically easy to control stirring process. The energy input can be varied by varying the stirrer geometry. The stirrer geometry can be varied by exchanging the stirrer as such or by applying a stirrer having a modifiable geometry. The energy may further be varied by varying the stirrer speed. The stirrer speed depends on the geometry of the stirrer and typically does not exceed 2000/min. The energy may also be varied by the duration of the stirrer treatment which may be in the range of 1 min to 60 min preferably 1 min to 20 min most preferably in the range of 1 min to 5 min.

According to an embodiment of the invention the first type particles are composed at least partially of valuable mineral, and the magnet type particles selectively agglomerate as a result of hydrophobic interactions.

Thus, the first type particles and the second type particles later can be separated by applying a magnetic field, as second type particles, composed mainly by undesired minerals do not have hydrophobic surfaces and therefore do not aggregate to magnet type particles.

For the purposes of the present invention, "hydrophobic" as in "hydrophobic particle" means that the corresponding particle can be hydrophobic by itself or can subsequently be hydrophobized by treatment with at least one surface-modifying substance. It is also possible for a particle which is hydrophobic per se to be additionally hydrophobized by treatment with at least one surface-modifying substance. Examples of surface-modifying substances include, but are not limited to, a hydrophobizing agent and a collector. Within the scope of the present invention, the term "hydrophobic" also includes that a "hydrophobized substance" such as a "hydrophobized magnetic particle" or a first type particle treated with a collector has a contact angle between water and the optionally hydrophobized surface of a particle against air of ≥90°.

In the scope of the present invention, "hydrophilic" means that a corresponding solid "hydrophilic particle" has a contact angle of water against air of <90°.

Methods to determine the contact angle are well known to the skilled artisan. For example, for the determination of the contact angel against water may be determined by optical drop shape analysis, e.g. using a DSA 100 contact angle measuring device of Krüsse (Hamburg, Germany) with the respective software. Typically 5 to 10 independent measurements are performed in order to determine a reliable average contact angle.

According to an embodiment of the invention during step (A) the amount of transferred energy is further specified in that an amount of energy between 0.05 to 5 kWh/m^3 is transferred into the mixture of the dispersion medium, the first type particles, the second type particles and the magnet type particles.

According to an embodiment of the invention during step (A) the amount of transferred energy is further specified in that an amount of energy between 0.05 and 1 kWh/m^3 is transferred into the mixture of the dispersion medium, the first type particles, the second type particles and the magnet type particles.

According to an embodiment of the invention during step (A) the amount of transferred energy is further specified in that an amount of energy between 0.01 to 0.2 kWh/m^3 is transferred into the mixture of the dispersion medium, the first type particles, the second type particles and the magnet type particles.

Thus, an improved process can be provided, when transferring an adapted amount of energy into the mixture of the dispersion medium, first type particles, second type particles and magnet type particles. The adapted amount of energy leads to an energy improved procedure, so that an optimum can be achieved between energy consumption and efficiency of the procedure.

According to an embodiment of the invention the amount of energy is transferred in step (A) by stirring for a time between 60 and 3600 seconds, preferred between 60 and 1200 seconds, more preferred between 60 and 300 seconds.

Thus, an optimum of energy transfer density can be achieved. The transferred energy is distributed over the particular time frame so that on the one hand overheating of the respective devices can be avoided and on the other hand the time for step (A) can be improved resulting in a speeding up of the process.

According to an embodiment of the invention the amount of energy is transferred in step (A) by stirring with a stirring speed between 50/min and 2000/min. The circumferential stirrer speed depends on the scale of the device and may vary accordingly. For example, for laboratory with 2 or 3 litre of a mixture in a small vessel, 500 to 600/min may be applied, while for a larger scale with 2 or 3 m^3 of a mixture in a larger vessel, 100 to 200/min may be applied, where a stirrer has exemplarily an impeller of 900 mm diameter.

Thus, the agglomeration can be improved in step (A). A slower stirring may lead to a slower formation of agglomerates, whereas a faster stirring may result in cleavage of the agglomerates. It should be understood that the entire process depends on a plurality of parameters, and the optimum of one parameter may lead to a situation which is not the optimum of the general process. In other words, the best process result may result from a parameter selection, where at least some parameters are not within an optimum range of that respective parameter. A longer stirring process may lead to a higher agglomeration, but the longer stirring may lead to worse efficiency.

According to an embodiment of the invention the stirrer is an axial pitched-blade impeller having at least two, preferably at least four blades, wherein the driving energy of the stirrer is a measure for the transferred amount of energy.

According to an embodiment of the invention the stirrer is an radial blade agitator, having at least two blades, preferably at least four blades, more preferably eight blades, wherein the driving energy of the stirrer is a measure for the transferred amount of energy.

According to an embodiment of the invention the effective diameter of the stirrer is between 20% and 50%, in particular between 25% and 40% of a diameter of a vessel in which the method is conducted.

According to an embodiment of the invention the first type particles are treated with a collector for hydrophobizing.

Thus, originally intrinsic hydrophilic metal compound particles, may be treated with a collector, so that after collector addition the intrinsically hydrophilic metal compound particles become hydrophobic, in which case they are hydrophobized.

In one embodiment, the first type particles has been pre-treated with at least one collector or wherein at least one collector is added in step (A).

According to one embodiment, the at least one collector is an ionizing collector or a non-ionizing collector.

According to one embodiment, the at least one collector is a compound of formula (I) or derivative thereof $$[(A)_m(Z)_n]_o \quad (I)$$

and wherein each A is independently selected from $C_1$-$C_{30}$-alkyl, $C_2$-$C_{30}$-alkenyl $C_1$-$C_{30}$-heteroalkyl, $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which may be unsubstituted or optionally substituted; each Z is independently selected from anionic groups, cationic groups or non-ionic groups;

m is an integer of 1, 2, 3, 4, 5, 6, 7, 8, 9 or 10;

n is an integer of 1, 2, 3, 4, 5, 6, 7, 8, 9 or 10; and o is an integer of 1, 2, 3, 4, 5, 6, 7, 8, 9 or 10 to 100.

According to a preferred embodiment, Z is selected from:

a)

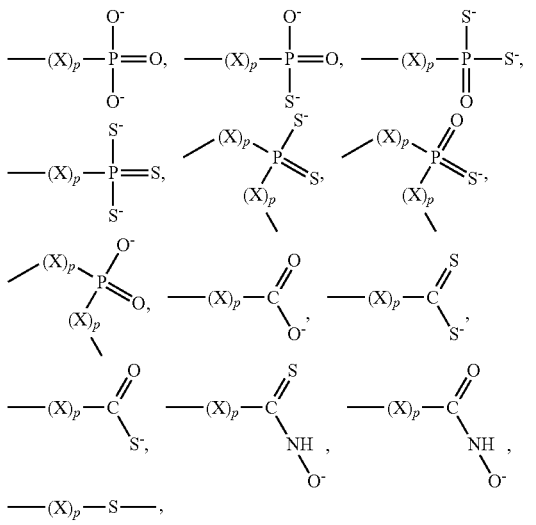

b)

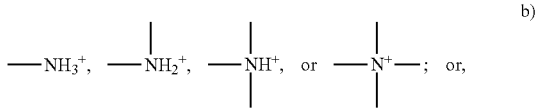

c)

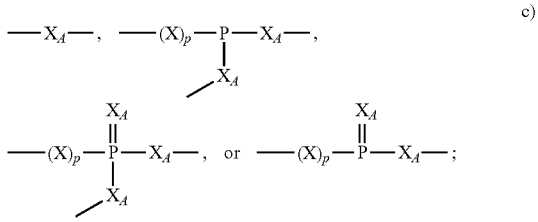

wherein each X is independently selected from the group consisting of O, S, NH, $CH_2$ and each p is independently selected from the integer 0, 1 or 2 and each $X_A$ is independently selected from O or S.

According to another preferred embodiment, the at least one collector is selected from:

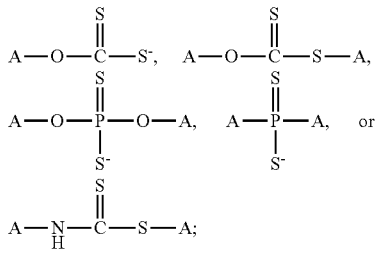

or a derivative thereof.

According to an embodiment of the invention the first type particles and the second type particles result from milled ore of a Copper Molybdenum (CuMo) type or a Copper Gold (CuAu) type.

Thus, the method may be used for gaining Copper Molybdenum or a Copper Gold from a respective ore.

According to an embodiment of the invention the ore comprising first type particles and second type particles before or during step (A) is milled to particles having a size of from 50 μm to 1000 μm, preferably from 100 μm to 250 μm, more preferably from 150 μm to 170 μm.

According to an embodiment of the invention the ore comprising first type particles and second type particles before or during step (A) is milled to particles having a size d80 of from 5 μm to 1000 μm, preferably from 10 μm to 250 μm. The actual particle size used depends on the one hand side on the grain size of the target minerals containing the valuable materials determining the degree of liberation of the first type particles and on economic considerations i.e. the energy consumption that increases with decreasing particle size.

Thus, an optimum particle size may be achieved for the process. Larger particles need a shorter milling, but may lead to a deterioration of the efficiency. Smaller particles may lead to a higher pureness of the separated material, but may require a longer milling and a higher energy consumption for the milling process.

According to an embodiment of the invention in the mixture of the dispersion medium, the first type particles, the second type particles and magnet type particles the first type particles and the second type particles together have a concentration between 10 and 70 wt.-%, preferably between 20 and 50, more preferably between 30 and 40%.

Thus, a proper agglomeration and also a subsequent separation may be achieved. Higher concentration of particles in the mixture of the dispersion medium, first type particles, second type particles and magnet type particles may lead to a higher viscosity leading to a lower mobility of the particles in the mixture. Mobility may have an influence e.g. on the agglomeration process and the separation process. A typical viscosity of the mixture of the dispersion medium, the first type particles and the second type particle may be between 1 mpa*s and 60 mpa*s depending on the weight % of solid particles in the dispersion.

According to an embodiment of the invention the magnet type particles are selected from the group consisting of magnetic metals and mixtures thereof, ferromagnetic alloys of magnetic metals and mixtures thereof, magnetic iron oxides, cubic ferrites of the general formula (II)

$$M^{2+}_{x}Fe^{2+}_{1-x}Fe^{3+}_{2}O_4 \quad \text{(II)}$$

where M is selected from among Co, Ni, Mn, Zn and mixtures thereof and $x \leq 1$, hexagonal ferrites and mixtures thereof.

According to an embodiment of the invention, the at least one magnetic particle is a hydrophobized magnetic particle.

According to another embodiment of the invention, the at least one hydrophobized magnetic particle is a magnetic particle treated with a hydrophobizing agent.

In a preferred embodiment, the hydrophobizing agent is a compound of formula (IV) or derivative thereof $$R^5_{v}—Si(OR^6)_{4-v} \quad \text{(IV)}$$

wherein each $R^5$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;

each $R^6$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;
and v is the integer 1, 2 or 3.

In another preferred embodiment, the compound of formula (IV) or derivative thereof is a compound selected from the group consisting of $(NaO)(CH_3)Si(OH)_2$, $(NaO)(C_2H_5)Si(OH)_2$, $(NaO)(C_5H_{11})Si(OH)_2$, $(NaO)(C_8H_{17})Si(OH)_2$, $(KO)(CH_3)Si(OH)_2$, $(KO)(C_2H_5)Si(OH)_2$, $(KO)(C_5H_{11})Si(OH)_2$, $(KO)(C_8H_{17})Si(OH)_2$, $(NH_4O)(CH_3)Si(OH)_2$, $(NH_4O)(C_2H_5)Si(OH)_2$, $(NH_4O)(C_5H_{11})Si(OH)_2$, $(NH_4O)(C_8H_{17})Si(OH)_2$, $(NaO)_2(CH_3)Si(OH)$, $(NaO)_2(C_2H_5)Si(OH)$, $(NaO)_2(C_5H_{11})Si(OH)$, $(NaO)_2(C_8H_{17})Si(OH)$, $(KO)_2(CH_3)Si(OH)$, $(KO)_2(C_2H_5)Si(OH)$, $(KO)_2(C_5H_{11})Si(OH)$, $(KO)_2(C_8H_{17})Si(OH)$, $(NH_4O)_2(CH_3)Si(OH)$, $(NH_4O)_2(C_2H_5)Si(OH)$, $(NH_4O)_2(C_5H_{11})Si(OH)$, $(NH_4O)_2(C_8H_{17})Si(OH)$, $(NaO)_3(CH_3)Si$, $(NaO)_3(C_2H_5)Si$, $(NaO)_3(C_5H_{11})Si$, $(NaO)_3(C_8H_{17})Si$, $(KO)_3(CH_3)Si$, $(KO)_3(C_2H_5)Si$, $(KO)_3(C_5H_{11})Si$, $(KO)_3(C_8H_{17})Si$, $(NH_4O)_3(CH_3)Si$, $(NH_4O)_3(C_2H_5)Si$, $(NH_4O)_3(C_5H_{11})Si$, $(NH_4O)_3(C_8H_{17})Si$, $(NaO)(CH_3)_2Si(OH)$, $(NaO)(C_2H_5)_2Si(OH)$, $(KO)(CH_3)_2Si(OH)$, $(KO)(C_2H_5)_2Si(OH)$, $(NaO)_2(CH_3)_2Si$, $(NaO)_2(C_2H_5)_2Si$, $(KO)_2(CH_3)_2Si$, $(KO)_2(C_2H_5)_2Si$, $Ca^{2+}[(O^-)(CH_3)Si(OH)_2]_2$, $Ca^{2+}[(O^-)(C_2H_5)Si(OH)_2]_2$, $Ca^{2+}[(O^-)(C_5H_{11})Si(OH)_2]_2$, $Ca^{2+}[(O^-)(C_8H_{17})Si(OH)_2]_2$, $Ca^{2+}[(O^-)(CH_3)_2Si(OH)]_2$, $Ca^{2+}[(O^-)(C_2H_5)_2Si(OH)]_2$, $Ca^{2+}[(O^-)_2(CH_3)Si(OH)]$, $Ca^{2+}[(O^-)_2(C_2H_5)Si(OH)]$, $Ca^{2+}[(O^-)_2(C_5H_{11})Si(OH)]$, $Ca^{2+}[(O^-)_2(C_8H_{17})Si(OH)]$, $Ca^{2+}[(O^-)_2(CH_3)_2Si]$, $Ca^{2+}[(O^-)_2(C_2H_5)_2Si]$ or combinations thereof.

Thus, proper magnet type particles can be provided being suitable for the entire process.

According to an embodiment of the invention the magnet type particles at least partially are magnetite particles or hydrophobized magnetite particles.

According to an embodiment of the invention the magnet type particles in the mixture of the dispersion medium, the first type particles, the second type particles and magnet type particles have a concentration between 0.01 and 100 g magnet type particles per 100 g of first and second type particles, preferably between 0.1 and 20 g magnet type particles per 100 g of first and second type particles, more preferably between 1 and 5 g magnet type particles per 100 g of first and second type particles.

The percentage of first type particles to second type particles depends on the stream of interest. In a typical mine tailing 0.1-1% of first type particles within first and second type particles can be encountered, typically, while in a rich ore stream this percentage may be considerably higher, for example 3-5%, but not limited to this values. A typical constellation may be a content of about 0.3% Chalcopyrite $CuFeS_2$ in an ore resulting in a content of about 0.1% Copper, and a concentration of about 0.3% Magnetite. A further typical constellation may be a content of about 3% Chalcopyrite $CuFeS_2$ in an ore resulting in a content of about 1% Copper, and a concentration of about 1 to 3% Magnetite.

Thus, the above described amount of magnet type particles are sufficient for the processing of first and second type particles. I.e. less than 5% of magnet type particles related to the amount of first and second type particles are sufficient for the method as described above. It should be noted that the amount of first and second type particles may correspond to the amount of milled ore.

According to an embodiment of the invention the dispersion medium is water.

Thus a cheap dispersion medium can be used having a high availability.

According to an embodiment of the invention the mixture of the dispersion medium, the first type particles, the second type particles and magnet type particles has a temperature between 0° C. and 45° C.

Thus, the process can take place above a temperature where the dispersion medium may freeze and a temperature where the agglomeration starts to dis-agglomerate.

It should be noted that the above features may also be combined. The combination of the above features may also lead to synergetic effects, even if not explicitly described in detail.

According to an embodiment of the invention the method after step (B) further comprises (C) dissociating magnetic agglomerates in particles containing first type particles and particles containing magnet type particles; and (D) separating particles containing magnet type particles from particles containing first type particles by applying a magnetic field.

Thus, the magnet type particles can be recycled and may be re-used. The separated magnet type particles, e.g. magnetite particles, can be fed back to be used in step (A). This improves the efficiency of the entire process.

As used herein, the term "derivative" such as in "a compound of formula (I) or derivatives thereof" preferably refers to salts, the protonated form or the deprotonated form of said compounds. Preferred salts as derivatives of a compound wherein the compound represents the anionic part of the salt include salts wherein the respective one or more cation of the salt is sodium, potassium, calcium, magnesium or $N(R^1)_4^+$, wherein $R^1$ is an unsubstituted or substituted $C_1$-$C_{12}$-alkyl Preferred salts as derivatives of a compound wherein the compound is the cation include salts wherein the respective one or more anion of the salt is Cl, Br, I, F, carbonate, phosphate, sulphate, sulphide or hydroxide and the like. The person skilled in the art is aware that the protonated and/or deprotonated form of a compound may depend on the pH in a dispersion.

As used herein, the term "optionally substituted" refers to a group that is either unsubstituted or substituted, e.g. with 1, 2, 3, 4 or 5 substituents. Preferred substituents are F, Cl, Br, I, OH, SH, —COOH, —$NH_2$, —CN, —C(O)$NH_2$ (amido), —C(O)NHC(O)—$C_1$-$C_{30}$-alkyl (imido), —O—$C_1$-$C_{30}$-alkyl (ether), —C(O)—$C_1$-$C_{30}$-alkyl (aldehyde), (=O), —S—$C_1$-$C_{30}$-alkylthioether, —C(O)NHOH (hydroxamate) or —N($R_1$)—C(O)OH (carbamate).

As used herein, the term "$C_1$-$C_{30}$-alkyl" refers to linear or branched hydrocarbons having 1 to 30 carbon atoms. Non-limiting example of $C_1$-$C_{30}$ alkyl include, but are not limited to methyl, ethyl, propyl, isopropyl, n-butyl, isobutyl, tert-butyl, pentyl, in particular n-pentyl, isopentyl, tert-pentyl, n-hexyl, isohexyl, tert-hexyl, n-heptyl, isoheptyl, tert-heptyl, n-octyl, isooctyl, tert-octyl, nonyl, n-nonyl, isononyl, tert-nonyl, n-decyl, isodecyl, tert-decyl, undecyl, n-undecyl, isoundecyl, tert-undecyl, or dodecyl, n-dodecyl, isododecyl or tert-dodecyl.

As used herein, the term "$C_2$-$C_{30}$-alkenyl" refers to linear or branched hydrocarbons having 2 to 30 carbon atoms and at least one C—C double bond. Examples of alkenyl which are particularly preferred according to the invention are ethenyl (vinyl), propenyl, in particular n-propenyl, isopropenyl, butenyl, n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl or tert-dodecenyl.

As used herein, the term "$C_1$-$C_{30}$-heteroalkyl" refers to linear or branched hydrocarbons having 1 to 30 carbon atoms and at least one heteroatom selected form the group consisting of N, O, P and S. The at least one heteroatom may be either the point of attachment, such as in -Het-$CH_2$—, part of the chain, such as in —$CH_2$-Het-$CH_2$—, or the heteroatom may be terminal, such as in —$CH_2$-Het, wherein "Het" denotes the heteroatom. In case the heteroatom is terminal, the free valences may be occupied by hydrogen or a $C_1$-$C_{30}$-alkyl group.

As used herein, the term "$C_6$-$C_{30}$-aryl" refers to aromatic carbocyclic rings of 6 to 30 ring members, including both mono, bi-, and tri-cyclic ring systems. Non-limiting examples of $C_6$-$C_{30}$-aryl include -indenyl, -phenyl, -naphthyl-, acenaphthyl-antranyl, -phenanthryl and the like.

As used herein, the term "$C_6$-$C_{30}$-cycloalkyl" refers to mono-, bi- or tricyclic saturated hydrocarbons having from 6 to 30 carbon atoms. Representative $C_6$-$C_{30}$-cycloalkyl include cyclohexyl, cecloheptyl, cyclooctyl, cyclononyl, cyclodecyl, cycloundecyl and cyclododecyl.

As used herein, the term "$C_6$-$C_{30}$ heterocycloalkyl" refers to a 6 to 30-membered mono-, bi- or tricyclic heterocyclic ring which is either saturated, unsaturated, non-aromatic or aromatic. The heteroatom in the heterocycloalkyl may be selected from O, S, P and N, wherein the nitrogen may be quarternized and the S may also be present in form of S(O) or $S(O)_2$.

As used herein, the term "$C_6$-$C_{30}$-aralkyl" refers to aromatic mono-, bi or tricyclic rings that are substituted with 1, 2, 3, 4 or 5 alkyl groups. Examples of $C_6$-$C_{30}$-arylalkyl include tolyl, xylyl, propylbenzyl and hexylbenzyl.

Findings from Experiments:

For the following examples 150 g of a Chilenean copper ore containing 0.87% of copper mainly as chalcopyrite and 0.026% molybdenum as molybdenite dry milled to average particle size of 170 μm $d_{80}$ is used. This ore was then milled as 57 w % aqueous slurry for 15 min in a planetary ball mill (Netsch PM400 at 200 rpm) with 20 mm zirconium balls as grinding medium without any addition of chemicals. The resulting solid material had an average particle diameter $d_{80}$ of 20 μm. The slurry obtained after milling was subsequently transferred to a 3 l conical glass vessel where it was diluted to a solid content of 30 w % and mixed with potassium octyl xanthate (650 g/ton ore), Shellsol D40 (400 g/ton ore) and magnetite carrier of average particle size $d_{80}$ of 9 μm coated with a polymethylsiloxane layer acc. to WO2012140065A1 (3 g/100 g ore, to promote its mixing in an aqueous medium, the hydrophobic magnetic carrier was pre-dispersed in a 0.1% solution of Lutensol XL80 (3 g of solution per g of magnetite)). The resulting mixture was then stirred for 15 min at 10 $sec^{-1}$ with different stirrers resulting in different power and energy up-takes. The stirring power is calculated from the formula $$P=\rho Ne n^3 d5$$

with r=density [$kg/m^3$], n=rotational speed of stirrer [$sec^{-1}$], d=stirrer diameter, Ne=Newton number [–].

The Newton no. is obtained from experimentally determined Reynolds no. and published correlations between Newton and Reynolds no. for different stirrer geometries (J. H. Rushton, E. W. Costich, H. J. Everett, Power Characteristics of mixing impellers, Part I, Chem. Eng. Progr. 46 (8) 395-404 (1950) and J. H. Rushton, E. W. Costich, H. J. Everett, Power Characteristics of mixing impellers, Part II, Chem. Eng. Progr. 46 (9) 467-476 (1950) for propeller with ring and radial flow impeller; J. G. van de Vusse Mixing by agitation of miscible liquids, Part I, Chem. Eng. Sci. 4/178-200 (1955) and J. G. van de Vusse Mixing by agitation of miscible liquids, Part II, Chem. Eng. Sci. 4/209-220 (1955) for pitched blade turbines). The specific energy up-take is obtained by dividing the stirring power by the suspension volume multiplied by the treatment time [h]. The average shear rate is calculated from the formula given by Camp and Stein (R. Camp, P. C. Stein, J. Bost. Soc. Civil. Eng., 30, 219 (1943) s. above) using the mass specific power input.

Example A

After the stirring the mixture is diluted to 10 w % solid content and passed through a magnetic separation device described in WO2010/031617 in order to separate the magnetic particles and agglomerated. These are dried and analyzed with respect to its copper content from which the recoveries of copper can be calculated.

Exemplary Examples are listed in the below table 1:

| No. | Re | Ne | stirrer diam. in m | power $kW/m^3$ | spec. energy $kWh/m^3$ | shear rate $sec^{-1}$ | % Cu recovery | stirrer |
|---|---|---|---|---|---|---|---|---|
| A1 | 1524 | 0.38 | 0.03 | 0.03 | 0.007 | 60 | 42 | propeller with ring |
| A2 | 2294 | 2 | 0.03 | 0.15 | 0.036 | 180 | 64 | 6 blade radial flow impeller |
| A3 | 6750 | 0.5 | 0.05 | 0.48 | 0.116 | 330 | 77 | pitch-blade turbine |

The examples above show that there is a lower limit of specific energy inputs below which the agglomeration and thus the recovery of the target mineral is insufficient while with increasing energy input the recoveries are also increasing.

Example B

For the following examples 600 g of a Chilenean copper ore containing 0.87% of copper mainly as chalcopyrite and 0.026% molybdenum as molybdenite dry milled to average particle size of 170 μm $d_{80}$ is used. The ore was milled as 57 w % aqueous slurry for 15 min in a planetary ball mill (Netsch PM400 at 200 rpm) with 20 mm zirconium balls as grinding medium without any addition of chemicals. The resulting solid material had an average particle diameter $d_{80}$ of 20 μm. The slurry obtained after milling was subsequently transferred to a 3 l baffled cylindrical glass vessel equipped with a 100 mm double pitch blade stirrer where it was diluted to a solid content of 30 w % and mixed with potassium octyl xanthate (650 g/ton ore), Shellsol D40 (400 g/tonore) and magnetite carrier of average particle size $d_{80}$ of 9 μm coated with a polymethylsiloxane layer acc. to WO2012140065A1 (3 g/100 g ore, to promote its mixing in an aqueous medium, the hydrophobic magnetic carrier was pre-dispersed in a 0.1% solution of Lutensol XL80 (3 g of solution per g of magnetite)). The resulting mixture was then stirred in two consecutive steps for different times and stirrer speeds. In another set of experiments the mixture was first cycled over a rotor stator mixer Cavitron CD1000 under varying times and rotor speeds in order to generate very high shear rates and power inputs. For the baffled stirred vessel the energy inputs are determined with the simulation software VISMIX (VisiMix Ltd. (http://www.visimix.com/). For the rotor stator mixer the energy input is calculated from the heat (i.e. temperature rise) introduced by the mixing. The shear rates are estimates using the formula of Camp and Stein with dynamic viscosities of about 0.005 Pasec.

In the first series of experiments the energy input was varied by different stirrer speeds and stirring times in the baffled vessel alone while in the second series of experiments the energy input is varied by first circulating the suspension over the rotor stator mixing device at varying times and rotor speeds. After the 2 step mixing procedure the resulting suspension is diluted to a solid content of 10 w % and fed to a magnetic separation device as described for the previous experiments.

In both series of experiments there is a clear tendency that at higher energy inputs the agglomeration determined by the copper recovery is reduced.

Exemplary Examples are listed in table 2 below:

| | step 1 | | | | step 2 | | | | | total |
|---|---|---|---|---|---|---|---|---|---|---|
| No | t (min) | Rate (rpm) | Power (kW/m$^3$) | shear rate sec$^{-1}$ | t (min) | Rate (rpm) | Power (kW/m$^3$) | shear rate sec$^{-1}$ | recov. rate Cu (%) | spec. energy kWh/m$^3$ |
| B1 | 5 | 377 | 2 | 520 | 10 | 220 | 0.43 | 240 | 80.88 | 0.26 |
| B2 | 5 | 377 | 2 | 520 | 90 | 220 | 0.43 | 240 | 76.04 | 0.83 |
| B3 | 20 | 887 | 26 | 2300 | 90 | 220 | 0.43 | 240 | 60.53 | 9.45 |
| B4 | 60 | 887 | 26 | 2300 | 90 | 220 | 0.43 | 240 | 46.27 | 27.0 |
| B5 | 0.7 | 14400 | 333 | 8200 | 90 | 220 | 0.43 | 240 | 81.82 | 4.35 |
| B6 | 2 | 14400 | 333 | 8200 | 90 | 220 | 0.43 | 240 | 72.53 | 11.8 |
| B7 | 20 | 7200 | 284 | 7500 | 90 | 220 | 0.43 | 240 | 51.46 | 95.3 |
| B8 | 60 | 8400 | 284 | 7500 | 90 | 220 | 0.43 | 240 | 6.52 | 285 |

Examples C

For the following examples 300 g of a Chilenean copper ore containing 0.87% of copper mainly as chalcopyrite and 0.026% molybdenum as molybdenite dry milled to average particle size of 170 μm $d_{80}$ is used without further milling. The ore is mixed with water in a 3 l cylindrical stirred vessel giving a 25 w % slurry. The vessel can be equipped with baffles and with two different kind of stirrers a radial impeller and an axial pitch blade stirrer as shown in the pictures below. After a short homogenization (~1 min) time potassium ethyl hexyl xanthate (200 g/ton ore) is added and stirred for one minute at the given rotational speed for this experiment. Then the magnetite carrier of average particle size $d_{80}$ of 9 μm coated with a polymethylsiloxane layer acc. to WO2015110555 A1 (1.5 g/100 g ore, to promote its mixing in an aqueous medium, the hydrophobic magnetic carrier was pre-dispersed in isopropanol (3 g per g of magnetite)) is added. After addition of the magnetite slurry into the pre-conditioned ore suspension the system was stirred for three more minutes at the specific stirrer speeds for the given experiment to ensure the agglomeration. The resulting torque of this agglomerated slurry on the stirrer (ViscoPakt stirring device from HitecZang) is recorded for power calculations.

| No. | spec. energy kWh/m$^3$ | spec. power kW/m$^3$ | shear rate sec$^{-1}$ | % Cu recovery | stirring system |
|---|---|---|---|---|---|
| C1 | 0.003 | 0.06 | 110 | 74 | axial |
| C2 | 0.02 | 0.4 | 280 | 84 | axial/baffled |
| C3 | 0.12 | 2.4 | 690 | 81 | axial/baffled |
| C4 | 0.3 | 6.0 | 1100 | 57 | axial/baffled |
| C5 | 0.005 | 0.11 | 150 | 70 | radial |
| C6 | 0.13 | 2.7 | 730 | 79 | radial/baffled |
| C7 | 0.38 | 7.7 | 1200 | 64 | radial/baffled |

Exemplary Examples are listed in the table 3 above

These examples show that for coarse particles similar dependencies of the valuable recovery from the specific energy inputs as in the case of small particles can be observed.

Choosing a logarithmic abscissa for both type of particles a bell shaped arrangement of data points is obtained.

The invention claimed is:

1. A method for separating particles from a mixture of at least first type particles and second type particles, the method comprising:

(A) contacting in a dispersion medium the first type particles and the second type particles with magnet type particles, wherein in the dispersion medium the first type particles agglomerate to the magnet type particles to provide magnetic agglomerates;

(B) separating the magnetic agglomerates from the second type particles by applying a magnetic field;

wherein during step (A) an amount of mechanical shear energy of 0.001-10 kWh/m$^3$ is transferred to the dispersion medium, the first type particles, the second type particles and the magnet type particles and wherein the mechanical shear energy is introduced into the dispersion by a stirred vessel, milling aggregates, rotor stator mixing devices, by a turbulent flow of the dispersion through a pipe conveyed by pumps or by gravity, static mixers, and/or counter current flow mixers.

2. The method according to claim 1, wherein the transferred energy is deformation energy transferred by stirring the dispersion medium, the first type particles, the second type particles and the magnet type particles.

3. The method according to claim 1, wherein the first type particles comprise a valuable mineral, and the magnet type particles selectively agglomerate as a result of a hydrophobic interactions.

4. The method according to claim 1, wherein the amount of transferred shear energy is of 0.05 to 5 kWh/m$^3$.

5. The method according to claim 1, wherein the amount of energy is transferred in step (A) by stirring for a time between 60 and 1500 seconds.

6. The method according to claim 1, wherein the first type particles are treated with a collector for hydrophobizing.

7. The method according to claim 1, wherein ore comprising the first type particles and the second type particles before or during step (A) is milled to particles having a size of from 50 μm to 1000 μm.

8. The method according to claim 1, wherein ore comprising the first type particles and the second type particles before or during step (A) is milled to particles having a size of from.

9. The method according to claim 1, wherein in the dispersion medium, the first type particles, the second type particles and the magnet type particles, the first type particles and the second type particles together have a concentration between 10 and 70 wt.-%.

10. The method according to claim 1, wherein the magnet type particles are selected from the group consisting of magnetic metals and mixtures thereof, ferromagnetic alloys of magnetic metals and mixtures thereof, magnetic iron oxides, cubic ferrites of the formula (II)

$$M^{2+}_{x}Fe^{2+}_{1-x}Fe^{3+}_{2}O_4 \quad (II)$$

where M is selected from among Co, Ni, Mn, Zn and mixtures thereof and $x \leq 1$, hexagonal ferrites, and any one mixture thereof.

11. The method according to claim 1, wherein the magnet type particles include magnetite particles or hydrophobized magnetite particles.

12. The method according claim 1, wherein the magnet type particles in the dispersion medium, have a concentration between 0.01 and 100 g magnet type particles per 100 g of the first and the second type particles.

13. The method according to claim 1, wherein the dispersion medium is water.

14. The method according to claim 1, after step (B) further comprising (C) dissociating the first type particles from the magnet type particles in the magnetic agglomerates; and (D) separating the magnet type particles from the dissociated first type particles by applying a magnetic field.

15. The method according to claim 1, further comprising a separation of any magnetic component contained in the mixture of the first type particles and the second type particles prior to the step (A).

16. A method for separating particles from a mixture that includes first type particles and second type particles, the method comprising:

(A) contacting in a dispersion medium that includes water the first type particles and the second type particles with magnet type particles, wherein before or during step (A) the first type particles and the second type particles are milled to particles having a size of from 100 μm to 250 μm, the first type particles and the second type particles together have a concentration between 10 and 70 wt.-% in the dispersion medium, and in the dispersion medium the first type particles agglomerate to the magnet type particles to provide magnetic agglomerates;

(B) separating the magnetic agglomerates from the second type particles by applying a magnetic field;

wherein during step (A) an amount of deformation energy of 0.05 to 1 $kWh/m^3$ is transferred by stirring of the dispersion medium, the first type particles, the second type particles and the magnet type particles.

17. The method according to claim 1, wherein the mixture has ahear rate from 100 to 1000 l/s.

18. The method according to claim 1, wherein the mixture has ahear rate from 300 to 1000 l/s.

19. The method according to claim 1, wherein the amount of transferred shear energy is of 0.001 to 5 $kWh/m^3$.

20. The method according to claim 1, wherein the amount of transferred shear energy is of 0.2-1.5 $kWh/m^3$.

* * * * *